US008863635B2

(12) United States Patent
Gardner et al.

(10) Patent No.: US 8,863,635 B2
(45) Date of Patent: Oct. 21, 2014

(54) TOOLS FOR USE WITH ROBOTIC SYSTEMS

(75) Inventors: Christopher W. Gardner, San Diego, CA (US); Benjamin V. Stratton, San Diego, CA (US); Aaron Robbins, San Diego, CA (US)

(73) Assignees: Science Applications International Corporation, McLean, VA (US); Spawar Systems Center Pacific, San Diego, CA (US)

( * ) Notice: Subject to any disclaimer, the term of this patent is extended or adjusted under 35 U.S.C. 154(b) by 1009 days.

(21) Appl. No.: 12/947,824

(22) Filed: Nov. 17, 2010

(65) Prior Publication Data

US 2011/0061521 A1 Mar. 17, 2011

Related U.S. Application Data

(62) Division of application No. 12/081,610, filed on Apr. 17, 2008, now Pat. No. 7,836,811.

(51) Int. Cl.
*F41A 23/00* (2006.01)

(52) U.S. Cl.
USPC ..... 89/40.04; 89/1.13; 901/1

(58) Field of Classification Search
USPC ..... 89/1.13, 40.04; 102/402; 901/1; 86/50; 414/376, 377, 386, 469, 539, 546, 743
See application file for complete search history.

(56) References Cited

U.S. PATENT DOCUMENTS

| | | | | |
|---|---|---|---|---|
| 2,763,190 | A | 9/1956 | Libman | 89/42.01 |
| 4,621,562 | A | 11/1986 | Carr et al. | 89/41.05 |
| 4,636,137 | A | 1/1987 | Lemelson | 414/730 |
| 4,676,713 | A * | 6/1987 | Voelpel | 414/590 |
| 5,158,419 | A * | 10/1992 | Kempf et al. | 414/539 |
| 7,134,375 | B2 * | 11/2006 | Fish, Jr. | 86/50 |
| 7,654,348 | B2 | 2/2010 | Ohm et al. | 180/9.32 |
| 7,814,821 | B2 * | 10/2010 | Chenel | 89/1.13 |
| 8,007,221 | B1 * | 8/2011 | More et al. | 414/680 |
| 2008/0105481 | A1 | 5/2008 | Hutcheson et al. | 180/209 |
| 2009/0050750 | A1 | 2/2009 | Goossen | 244/76 R |
| 2009/0116946 | A1 * | 5/2009 | Chenel | 414/679 |
| 2009/0294218 | A1 * | 12/2009 | Archer et al. | 187/237 |
| 2009/0294584 | A1 | 12/2009 | Lovell et al. | 244/110 F |
| 2009/0314554 | A1 | 12/2009 | Couture et al. | 180/8.7 |
| 2012/0137862 | A1 * | 6/2012 | Kossett et al. | 89/1.13 |
| 2014/0031977 | A1 * | 1/2014 | Goldenberg et al. | 700/245 |

OTHER PUBLICATIONS

Foster-Miller—TALON Robots, "TALON® Military Robots, EOD, SWORDS, and Hazmat Robots," [retrieved on Mar. 31, 2008], 3 pp., Retrieved from the Internet: http://www.fostermiller.com/pages/printerfriendly.asp?type=page&key=lemming.

Foster-Miller—TALON Robots, "Gordon the EOD Robot—A TALON® Robot Story From Baghdad, Summer of 2007," [retrieved on Mar. 31, 2008], 1 p., Retrieved from the Internet: http://www.fostermiller.com/pages/printerfriendly.asp?type=page&key=lemming.

(Continued)

*Primary Examiner* — Gabriel Klein
(74) *Attorney, Agent, or Firm* — Dawn-Marie Bey; Bey & Cotropia PLLC

(57) ABSTRACT

Systems are described herein for remotely aligning and placing disruptive devices at or near suspicious targets such as suspected improvised explosive devices (IEDs). In particular, tools connected to remotely controllable robots include disruptor guns for firing disruptive materials at the targets and disruptive devices filled with explosive materials, e.g., water, for controllably detonating or disrupting the detonation of the targets when placed in close proximity thereto.

7 Claims, 21 Drawing Sheets

(56) References Cited

OTHER PUBLICATIONS

Foster-Miller—TALON Robots, "TALON® Robots—TALON SWAT/MP," [retrieved on Mar. 31, 2008], 1 p., Retrieved from the Internet: http://www.fostermiller.com/pages/printerfriendly.asp?type=page&key=lemming.
Foster-Miller—TALON Robots, "MAARS™ Robot," [retrieved on Mar. 31, 2008], 1 p., Retrieved from the Internet: http://www.fostermiller.com/pages/printerfriendly.asp?type=page&key=lemming.
Foster-Miller—TALON Robots, "Foster-Miller Ground Robotics," [retrieved on Mar. 31, 2008], 2 pp., Retrieved from the Internet: http://fostermiller.com/pages/printerfriendly.asp?type=page&key=lemming.
Foster-Miller—TALON Robots, "TALON® Robots Brochure," [retrieved on Mar. 31, 2008], 2 pp., Retrieved from the Internet: http://www.fostermiller.com/pages/printerfriendly.asp?type=page&key=lemming.
Foster-Miller—TALON Robots, "TALON®—Small Mobile Weapons for Force Protection," [retrieved on Mar. 31, 2008], 2 pp., Retrieved from the Internet: http://www.fostermiller.com/pages/printerfriendly.asp?type=page&key=lemming.
Foster-Miller—TALON Robots, "TALON™—Engineer—IED Detection/Road Clearance Robot for Combat Engineers," [retrieved on Mar. 31, 2008], 1 p., Retrieved from the Internet: http://www.fostermiller.com/pages/printerfriendly.asp?type=page&key=lemming.
Foster-Miller—TALON Robots, "TALON® Robots—Second-Generation TALON Hazmat Robot," [retrieved on Mar. 31, 2008], 2 pp., Retrieved from the Internet: http://www.fostermiller.com/pages/printerfriendly.asp?type=page&key=lemming.
Foster-Miller—TALON Robots, "TALON® Robots—Fido Integration Kit," [retrieved on Mar. 31, 2008], 2 pp., Retrieved from the Internet: http://www.fostermiller.com/pages/printerfriendly.asp?type=page&key=lemming.
Foster-Miller—TALON Robots, "TALON® Robots—Trailer and Hitch," [retrieved on Mar. 31, 2008], 2 pp., Retrieved from the Internet: http://www.fostermiller.com/pages/printerfriendly.asp?type=page&key=lemming.
Foster-Miller—TALON Robots, "TALON® Robots—X-Ray Kit," [retrieved on Mar. 31, 2008], 2 pp., Retrieved from the Internet: http://www.fostermiller.com/pages/printerfriendly.asp?type=page&key=lemming.
Foster-Miller—TALON Robots, "The Soldier's Choice, TALON™ Robots—TALON™ E-Mails From Iraq," [retrieved on Mar. 31, 2008], 2 pp., Retrieved from the Internet: http://www.fostermiller.com/pages/printerfriendly.asp?type=page&key=lemming.
Shachtman, Noah, "The Baghdad Bomb Squad," *Wired Magazine*, Issue 13.11, Nov. 2005 [retrieved on Mar. 31, 2008], 3 pp., Retrieved from the Internet: http://www.wired.com/wired/archive/13.11/bomb.html.
Master Sgt. Bryan Ripple, "Ordnance Disposal Makes for No Ordinary Day," Apr. 11, 2007, [retrieved on Mar. 31, 2008], Foster-Miller—TALON Robots, 2 pp., Retrieved from the Internet: http://www.fostermiller.com/pages/printerfriendly.asp?type=page&key=lemming.
Foster-Miller—TALON Robots, "Certificate of Registration," Foster-Miller, Inc. [retrieved on Mar. 31, 2008], 1 pp., Retrieved from the Internet: http://www.fostermiller.com/pages/printerfriendly.asp?type=page&key=lemming.
Foster-Miller—TALON Robots, "Terms and Conditions of Purchase, Robot Parts and Components," [retrieved on Mar. 31, 2008], 5 pp., Retrieved from the Internet: http://www.fostermiller.com/pages/printerfriendly.asp?type=page&key=lemming.
Yamauchi, Brian, "Daredevil: Ultra Wideband Radar Sensing for Small UGVs," *In Proceedings of SPIE: Unmanned Systems Technology IX*, Orlando, Florida, 9 pp., Apr. 2007.
Rudakevych, Pavlo, et al., "Integration of the Fido Explosives Detector onto the PackBot EOD UGV," *In Proceedings of SPIE*, vol. 6561, 11 pp., Mar. 2007.
Rudakevych, Pavlo, "A Man Portable Hybrid UAV/UGV System," *In Proceedings of SPIE*, vol. 6561, 10 pp., Mar. 2007.
Jones, Chris, et al., "Sentinel: An Operator Interface for the Control of Multiple Semi-Autonomous UGVs," *In Proceedings of the Association for Unmanned Vehicles Systems International*, Orlando, Florida, 15 pp., Aug. 2006.
Yamauchi, Brian, "Autonomous Urban Reconnaissance Using Man-Portable UGVs," *In Proceedings of SPIE: Unmanned Ground Vehicle Technology VIII*, Orlando, FL, 11 pp., Apr. 2006.
Yamauchi, Brian, "Wayfarer: An Autonomous Navigation Payload for the PackBot," *In Proceedings of AUVSI Unmanned Vehicles North America 2005*, Baltimore Maryland, 15 pp., Jun. 2005.
Barnes, Mitch, et al., "ThrowBot: Design Considerations for a Man-Portable Throwable Robot," *In Proceedings of SPIE*, vol. 5804, 10 pp., Mar. 2005.
Rudakevych, Pavlo, et al., "PackBot EOD Firing System," *In Proceedings of SPIE*, vol. 5804, 14 pp., Mar. 2005.
Yamauchi, Brian, "The Wayfarer Modular Navigation Payload for Intelligent Robot Infrastructure," *In Proceedings of SPIE: Unmanned Ground Technology VII*, Orlando, FL, vol. 5804, 12 pp., Mar. 2005.
Yamauchi, Brian, et al., "Griffon: A Man-Portable Hybrid UGV/UAV," *Industrial Robot*, vol. 31, No. 5, pp. 443-450, 2004.
Yamauchi, Brian, "PackBot: A Versatile Platform for Military Robotics," *In Proceedings of SPIE: Unmanned Ground Vehicle Technology VI*, Orlando Florida, vol. 5422, 10 pp., Apr. 2004.
Rudakevych, Pavlo, "Wave Control: A Method of Distributed Control for Repeated Unit Tentacles," *In Proceedings of SPIE*, vol. 3839, pp. 328-336, Aug. 1999.
Rudakevych, Pavlo, et al., "Micro Unattended Mobility System (MUMS)," *In Proceedings of SPIE*, vol. 3713, pp. 142-159, Jul. 1998.

* cited by examiner

TOOLS FOR USE WITH ROBOTIC SYSTEMS

CROSS-REFERENCE TO RELATED APPLICATIONS

This application is a divisional of U.S. patent application Ser. No. 12/081,610 filed Apr. 17, 2008 now U.S.Pat. No. 7,836,811, entitled "TOOLS FOR USE WITH ROBOTIC SYSTEMS," the disclosure of which is specifically incorporated herein by reference.

GOVERNMENT RIGHTS IN INVENTION

This invention was made with Government support under contract no. N66001-06-D-5021, DO 0010 awarded by the Department of the Navy. The Government has certain rights in this invention.

BACKGROUND OF THE INVENTION

1. Field of the Invention

The present invention relates generally to the field of explosive ordinance disposal (EOD) and more particularly to EOD using robotic devices with various disposal attachments thereon.

2. Description of the Related Art

There are many situations in which police, military personnel or others require the ability to dispose of or render safe an explosive device, e.g., landmines, improvised explosive devices (IEDs), CBRN (chemical/biological/radiological/nuclear) devices, etc. while minimizing risk to themselves and others. Remotely operated robots have been developed to investigate potential explosive devices and in some cases are used to disable the devices or to detonate in a controlled manner. Examples of such robots include the PackBot series available from iRobot and the Talon series available from Foster Miller.

The iRobot PackBot and the Foster Miller Talon may be used to disrupt IEDs, military ordnance, land mines, etc. Both the PackBot and the Talon utilize an extendible arm and may include a gripper for picking up and placing different sized objects, including disruptors. Disruptors are devices that contain, e.g., gunpowder, water or other disruptive material. The disruptors may be in the shape of a plastic water bottle, briefcase or the like. The disruptors are placed close to, for example, an IED, in order to detonate or disable the IED. There are numerous accessories available for the PackBot in order to facilitate disruption including, for example, a flipper tool bar kit and a main ordnance lift kit which attach to the PackBot and uses flippers to move implements up and down.

The PackBot and Talon robots may also work with disruptor guns which fire projectiles, e.g., water, clay, rubber bullets, and the like at IEDs in order to disrupt the trigger mechanism and or facilitate controlled detonation. Additional accessories have been developed by other companies, e.g., Proparms Ltd. and Ideal Products, to work with the PackBot, Talon and other robots. Ideal Products offers a trade named PAN Disruptor™ wherein PAN stands for Percussion Actuated Non-electric. The PAN Disruptor™ is a tool that is connected to the arm of a robot to safely dismember and disarm explosive packages with unknown content by firing water, clay or lead shot to take apart packages with unknown content.

SUMMARY OF THE INVENTION

Summary of the Problem

A major obstacle to successfully disabling explosives is the risk posed to EOD personnel. The ability to remotely disable is desired. Further, current configurations for placing disruptors are unreliable as the arms on the PackBot and Talon robots are unable to carry the weight of and sustain the loading required by the disruptors.

Summary of the Solution

The embodiments of the present invention facilitate disabling explosives while minimizing risk to EOD personnel. In a first exemplary embodiment, a system for placing a gun barrel within firing distance of a target is described. The system comprises: a remote controlled vehicle including a remotely controllable arm; a first component attached to the vehicle, the first component including parallel vertical tracks; and a second component including first and second sets of rollers for rolling the second component along the parallel vertical tracks, the second component further including a gun barrel positioned approximately perpendicular to the parallel vertical tracks.

In a second exemplary embodiment, an alternative system for placing a gun barrel within firing distance of a target is described. The system comprises a remote controlled vehicle including a remotely controllable arm and a component attached to the vehicle including a clamp for holding the gun barrel, support means connected to the clamp and including at least one shock absorber, and attachment means for attaching the component to the vehicle.

In a third exemplary embodiment, a system for placing a disruptive device near a target is described. The system comprises: a remote controlled vehicle including a remotely controllable arm; a first subsystem; and a second subsystem including a holder for holding the disruptive device and a release mechanism for releasing the disruptive device near the target. The first subsystem includes a movable arm, a hook, a retaining pin, and a lowering mechanism. The release mechanism releases the disruptive device from the holder when the remotely controllable arm causes the movable arm to unhook the hook from the retaining pin which causes the lowering mechanism to drop the second subsystem which triggers the release mechanism.

In a fourth exemplary embodiment, an alternative system for placing a disruptive device near a target is described. The system comprises a remote controlled vehicle including a remotely controllable lowering mechanism and a subsystem including a holder for holding the disruptive device and a release mechanism for releasing the disruptive device near the target. The release mechanism includes a cam, at least one buckle, at least one strap, and a foot actuator. The release mechanism releases the disruptive device from the holder when the lowering mechanism causes the subsystem to drop and the foot actuator hits the ground causing the cam to release the buckle which holds the strap, thus releasing the disruptive device from the holder.

In a fifth exemplary embodiment, an alternative system for placing a disruptive device near a target is described. The system comprises a remote controlled vehicle including a remotely controllable arm and a subsystem that includes a movable arm, a hook, a retaining pin, a lowering mechanism, a pivot component; and a holder for holding the disruptive device. The disruptive device slides off of the holder when the remotely controllable arm causes the movable arm to unhook the hook from the retaining pin which causes the lowering mechanism to cause the holder to pivot around the pivot component, thus lowering an edge of the holder and causing the disruptive device to slide off of the holder.

BRIEF DESCRIPTION OF THE FIGURES

The preferred embodiments of the present invention are illustrated by way of example and not limited to the following figures.

DETAILED DESCRIPTION OF THE INVENTION

Figure 1A:
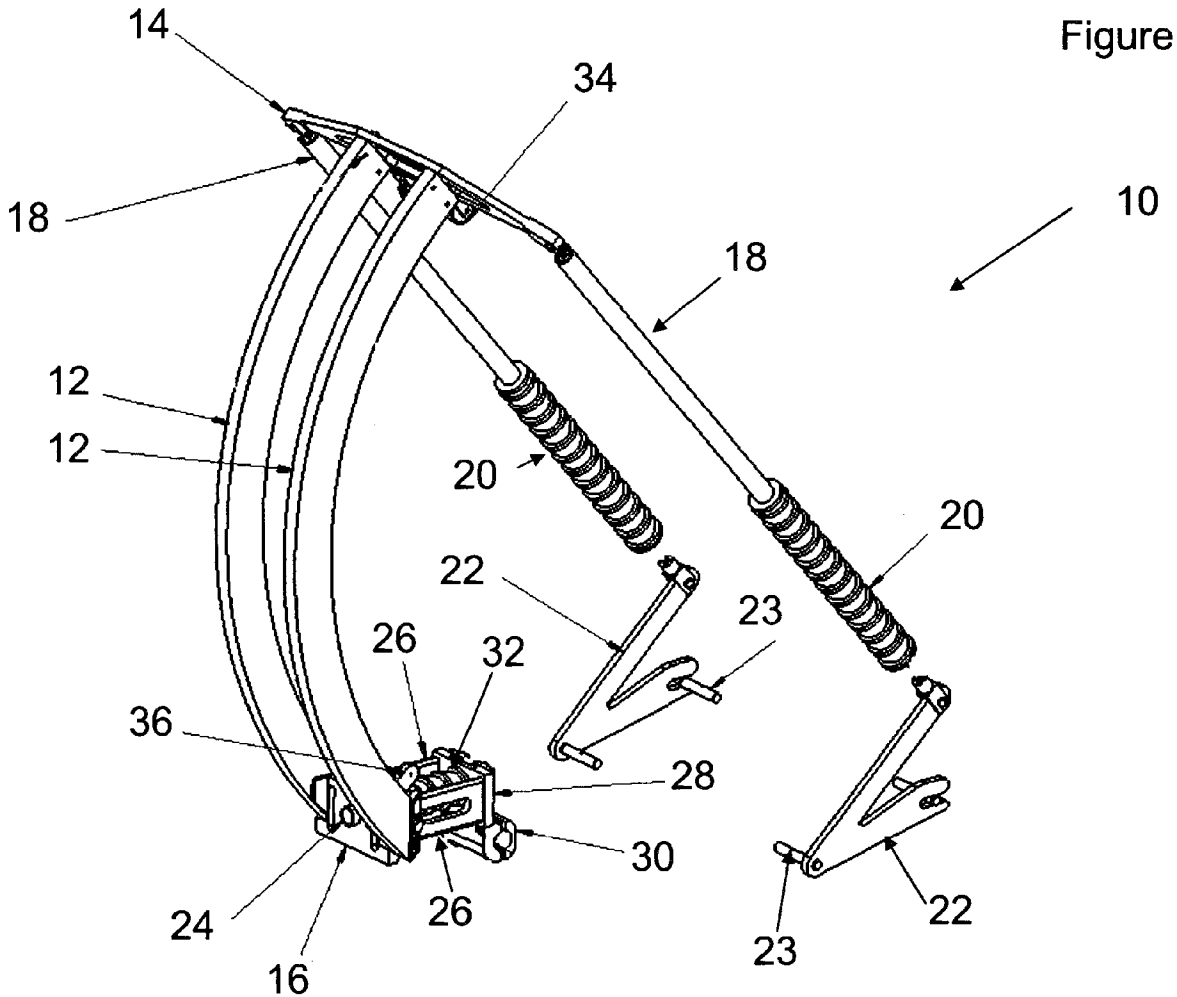
FIGS. 1(*a*) to 1(*c*) illustrate an embodiment of the present invention including a disruptor assembly for use with a first prior art robot.
Figure 1B:
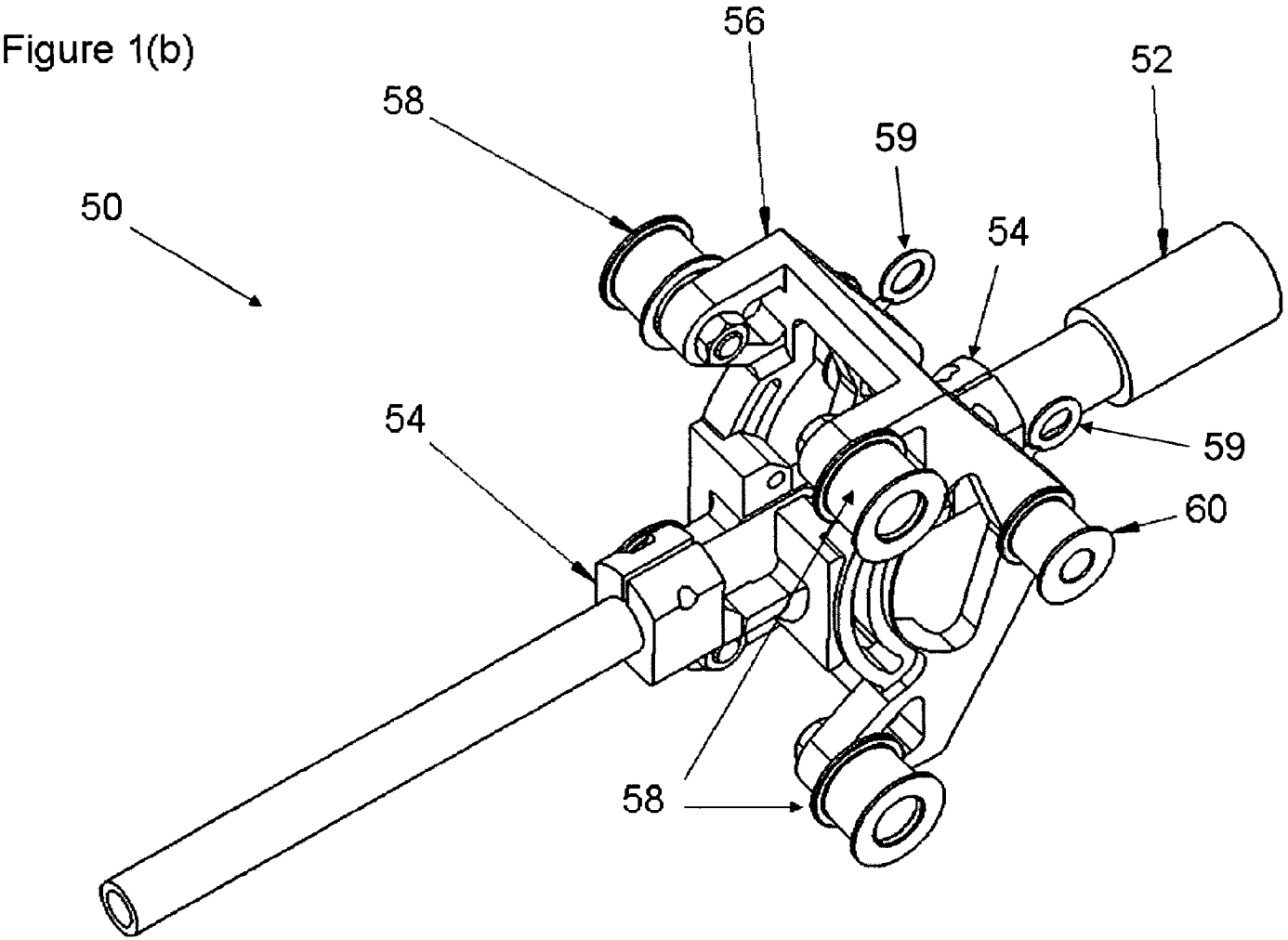
Figure 1C:
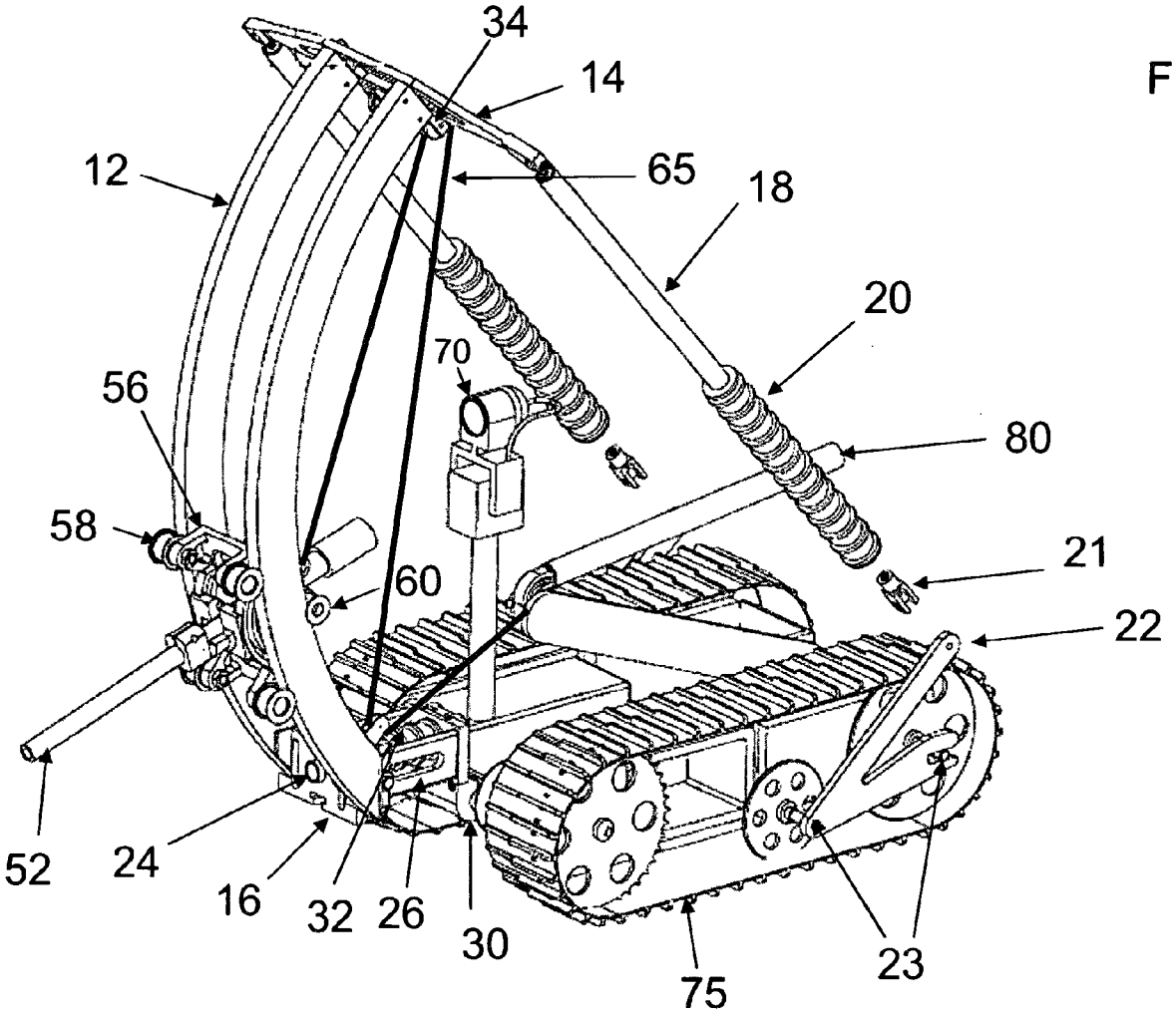

FIGS. 1(*a*) and 1(*b*) illustrate a tool for attaching a pan disruptor to Foster Miller's Talon robot. A pan disruptor is essentially a gun that can fire several different types of projectiles, e.g., water, bullets, clay, etc. depending on the need. The Foster Miller Talon may be fitted with the pan disruptor described in the preferred embodiment either directly or via a trailer skid assembly as described herein with respect to FIGS. 2(*a*) through 2(*c*).

Referring to FIG. 1(*a*), a first component 10 of the pan disruptor assembly includes rails 12 attached directly to a top shock support 14 and front support block 16. Top shock support 14 is attached to a first end of upper recoil supports 18 which include shock absorbers 20. The second end of the upper recoil supports 18 are attached to rear axle braces 22 including rear axle support pins 23 (four pins shown). Rear axle support pins 23 are used to attach component 10 to the Talon robot (see FIG. 1(*c*)). The front support block 16 is attached to a horizontal recoil support 24 and a first end of front support slides 26. Front support slides 26 attach to a pan mount outer tool clip 28 which is attached to bottom tool clamp 30. Horizontal recoil support 24 includes a shock absorber 32. The first component 10 further includes upper and lower pulleys 34, 36 (two of each). As will be discussed later, these pulleys are used in conjunction with the robot arm 80 to move first component 10 in order to align the disruptor.

Referring to FIG. 1(*b*), a second component 50 includes the actual gun or pan disruptor barrel 52 which is secured within a roller system including clamps 54 which are attached to a mount 56 having four large rollers 58 (one hidden from view) and two small rollers 60 (one hidden from view). As will be described below, the rollers allow for vertical adjustment of the pan disruptor barrel along the rails 12 via eyelet hooks 59.

FIG. 1(*c*) illustrates the combination of components 10 and 50 mounted on Talon robot 75.

The first component 10 is attached directly to the Talon robot 75 at multiple connection points via the pan mount outer tool clip 28 and bottom tool clamp 30 and via rear axle braces 22 and support pins 23 as shown in FIG. 1(*c*). During operation, the rails 12 are able to slide horizontally along the length of the front support slides 26 and shock absorbers 20 and 32 absorb recoil from the firing of the disruptor gun 52. Additionally, the disruptor gun 52 can be positioned vertically (and to some extent horizontally) along the arc of the rails 12 in combination with the roller system, e.g., rollers 58 and 60 and eye hooks 59 described with respect to FIG. 1(*b*), pulleys 34, 36 and a movable arm 80 of the Talon robot 75 which are connected via cables 65 (one of two shown). More particularly, the moveable arm 80 of the Talon robot is controlled electromechanically and wirelessly by a user. Movement of the arm 80 causes the cables 65 to pull against eyelet hooks 59 and move roller system and disruptor gun 52 along the rails 12 via pulleys 34, 36.

Further to FIG. 1(*c*), a camera 70 which is located on the robot 75 may be used to help a user to visually align the disruptor gun 52 with the intended target (not shown). Alternatively, a camera may be mounted on the roller system in order to provide more precise visual information for alignment purposes.

Figure 2A:
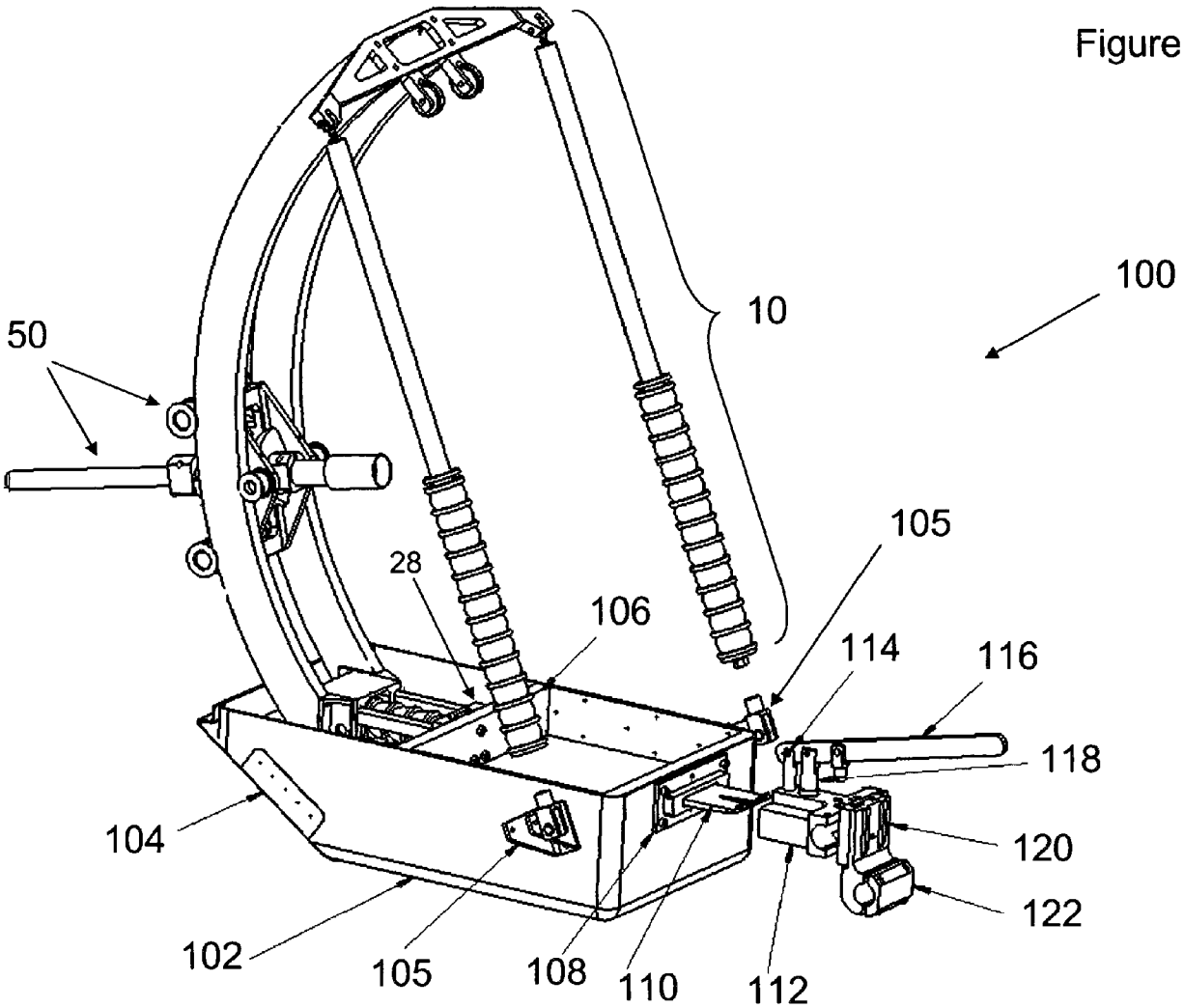
FIGS. 2(*a*) to 2(*c*) illustrate an embodiment of the present invention including a disruptor assembly with trailer for use with a first prior art robot.
Figure 2B:
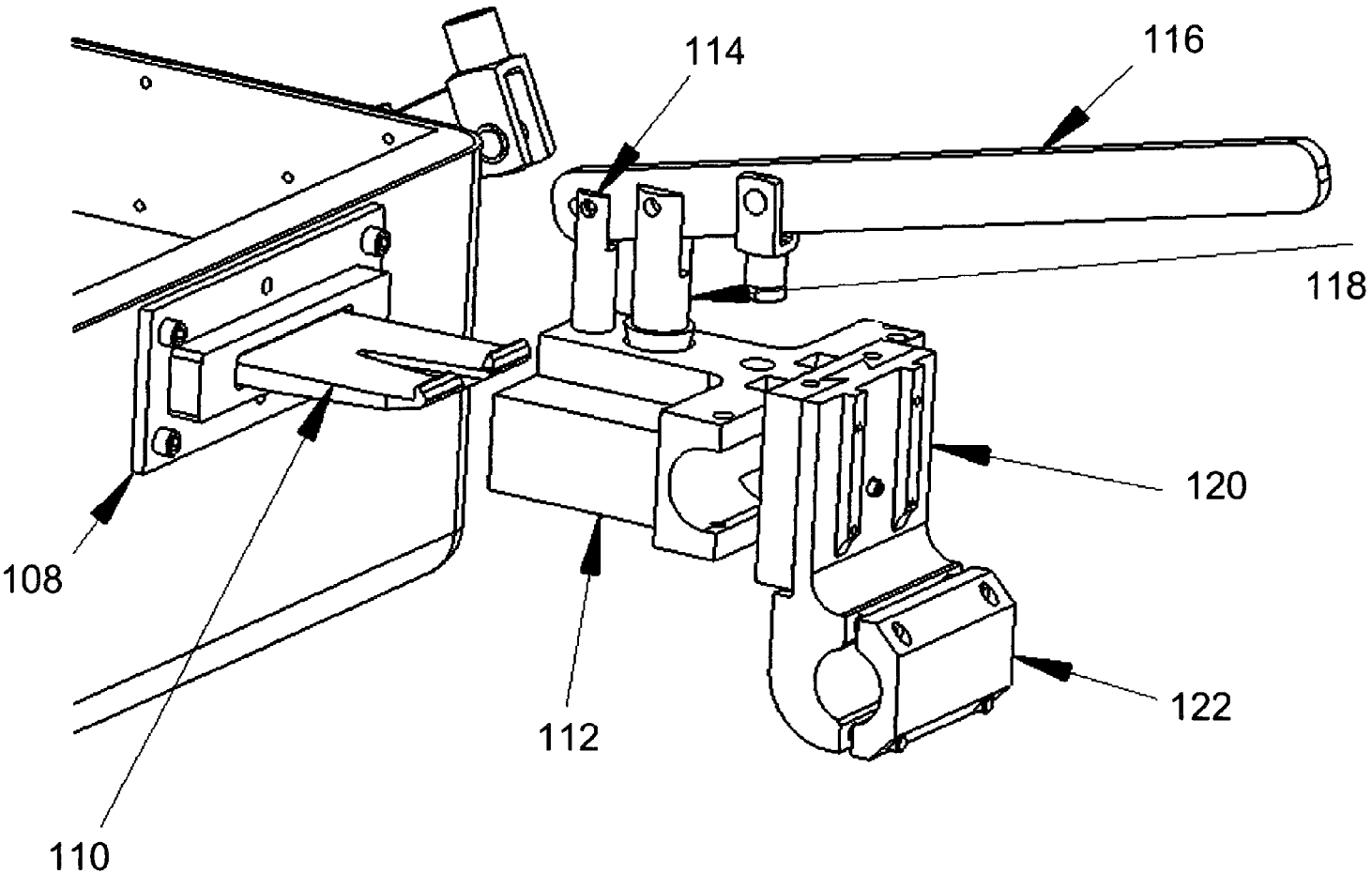
Figure 2C:
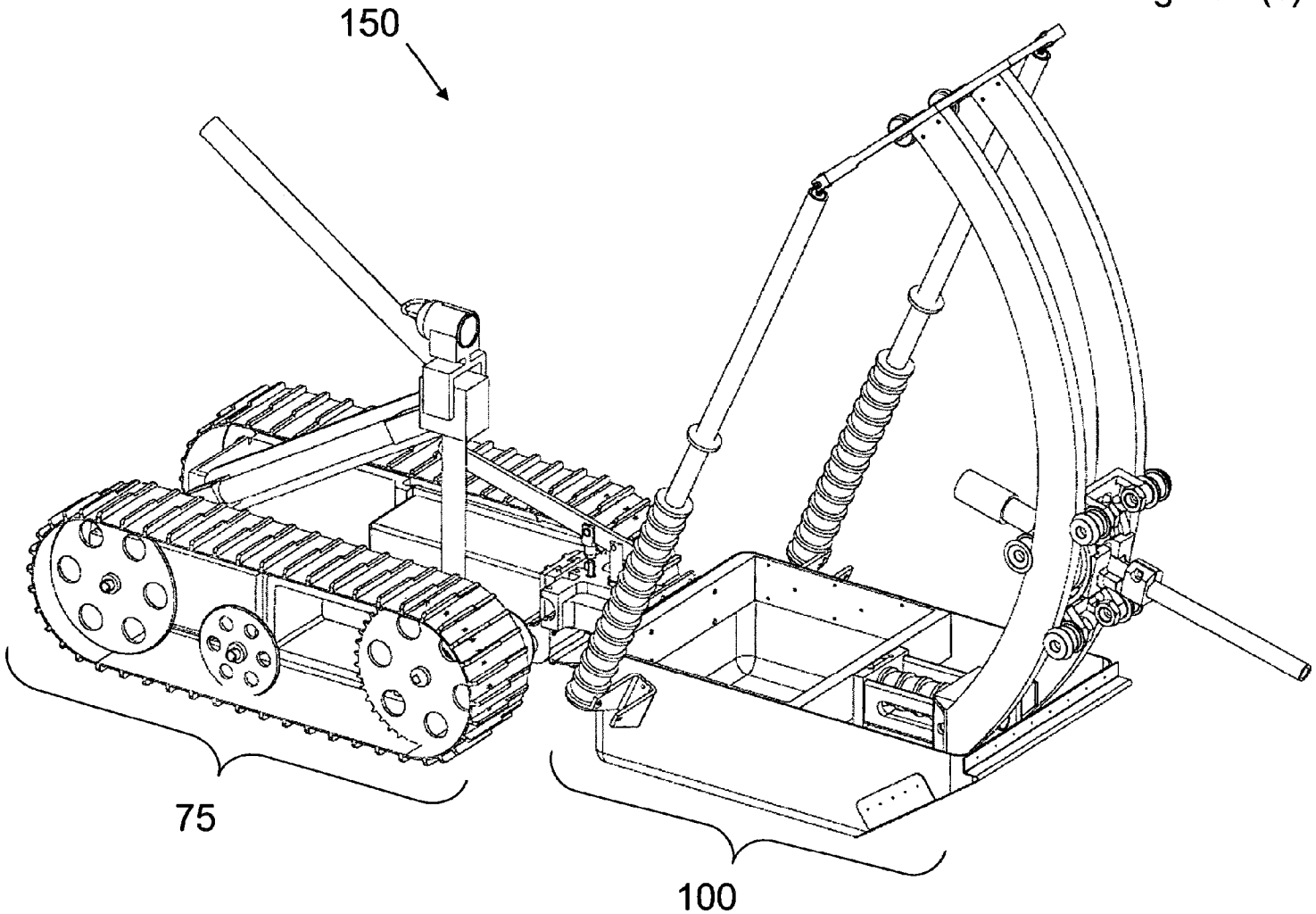

Referring to FIGS. 2(*a*) through 2(*c*), in a second exemplary embodiment 100, the first and second components 10 and 50 are not directly attached to the Talon robot 75 as shown in FIG. 1(*c*), but alternatively, reside on a trailer skid 102. In FIGS. 2(*a*) through 2(*c*), the parts and reference numerals from FIGS. 1(*a*) and 1(*b*) are not repeated in all cases as many parts are identical. The trailer skid 102 includes a skid belly pan 104 and skid box 106. The first component 10 is attached to the skid box 106 via outrigger blocks 105. At the back of the skid box 106 there is a retainer 108 for male hitch pad 110 which receives female hitch block 112 for connecting the skid 102 to the Talon robot (see FIG. 2(*c*)). Further, connected to the female hitch block 112 are top tool pad 120 and bottom tool clamp 122 for directly attaching to the Talon robot. This configuration varies from that described with reference to FIGS. 1(*a*) to 1(*c*) in that the single connection point to the Talon robot is via top tool pad 120 and bottom tool clamp 122. This embodiment does not include bottom tool clamp 30 since the pan mount outer tool clip 28 attaches directly to the skid box 106. The female hitch block 112 is controllably connected to and released from the male hitch pad 110 via hitch pad actuator arm 116, front pivot clevis 114 and pad locking pin 118.

With respect to this second exemplary embodiment, the location, e.g., elevation, of the disruptor gun 52 is controlled in the same manner as described above with respect to the first exemplary embodiment (cables, etc. not shown). FIG. 2(*c*) illustrates system 150 which includes trailer skid with pan disruptor assembly 100 attached to Talon robot 75.

One skilled in the art recognizes that the there are numerous nuts, bolts, screws and the like which are used to attach the components described herein. Accordingly, these nuts, bolts, screws, etc. are not discussed individually. While the pan disruptor configurations shown with respect to FIGS. 1 and 2 are described as being useful with the Talon robot, these are meant to be exemplary. One skilled in the art understands that the tool configurations may be modified in order to attach to other robots having a component with a function similar to the movable arm 80 for positioning the disruptor gun via the pulley system.

Figure 3A:
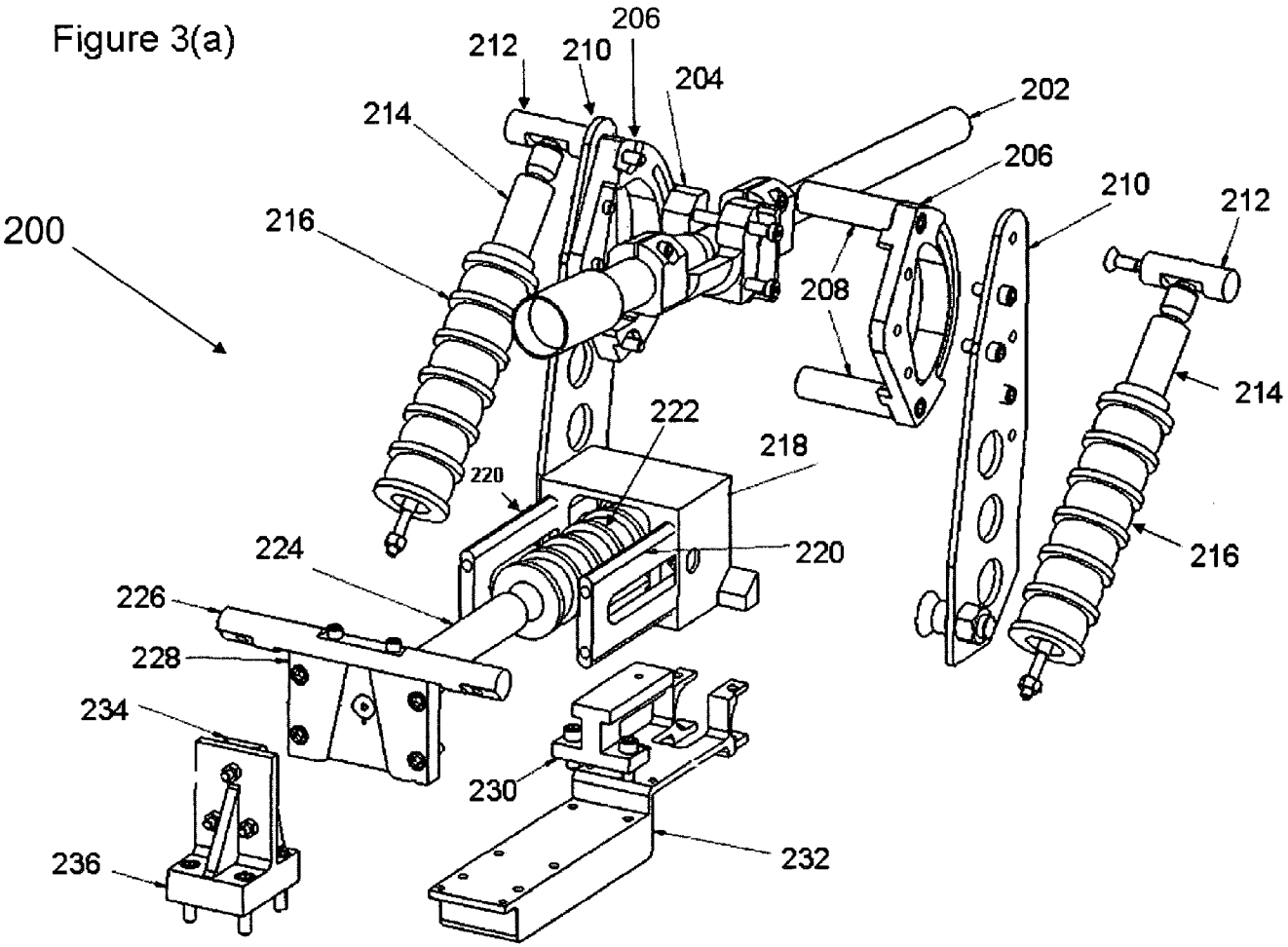
FIGS. 3(*a*) to 3(*c*) illustrate an embodiment of the present invention including a disruptor assembly for use with a second prior art robot.
Figure 3B:
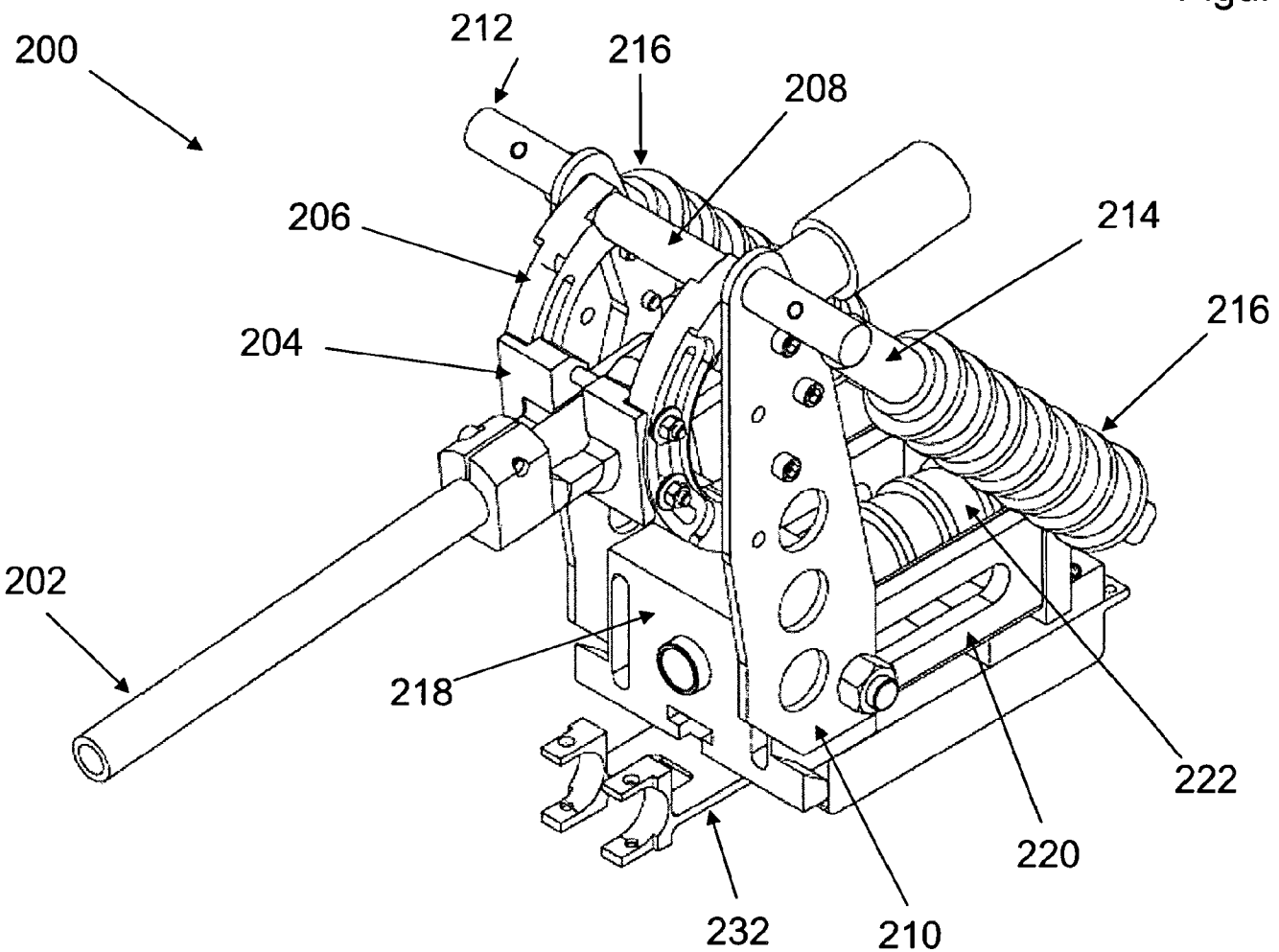
Figure 3C:
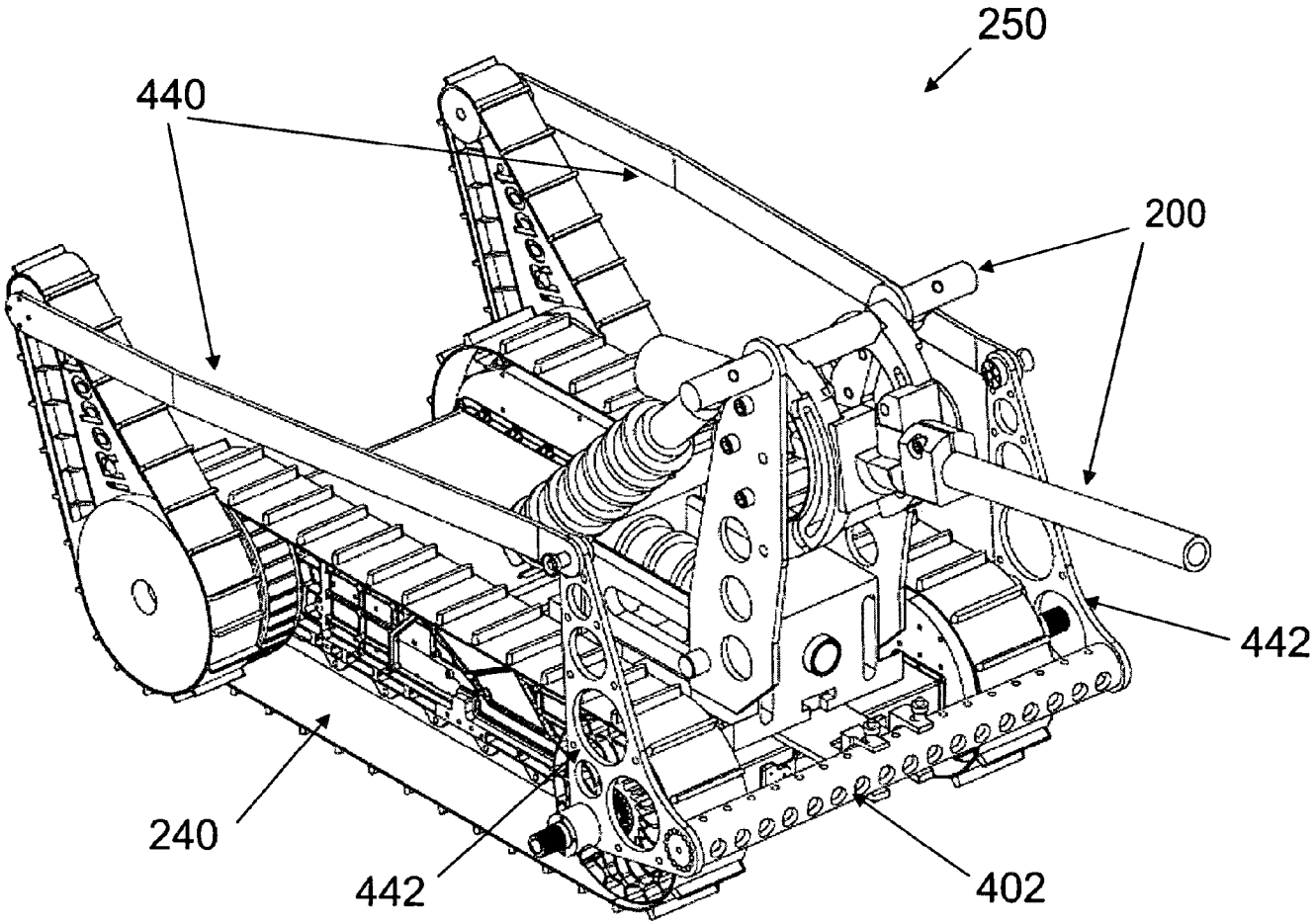
Figure 4A:
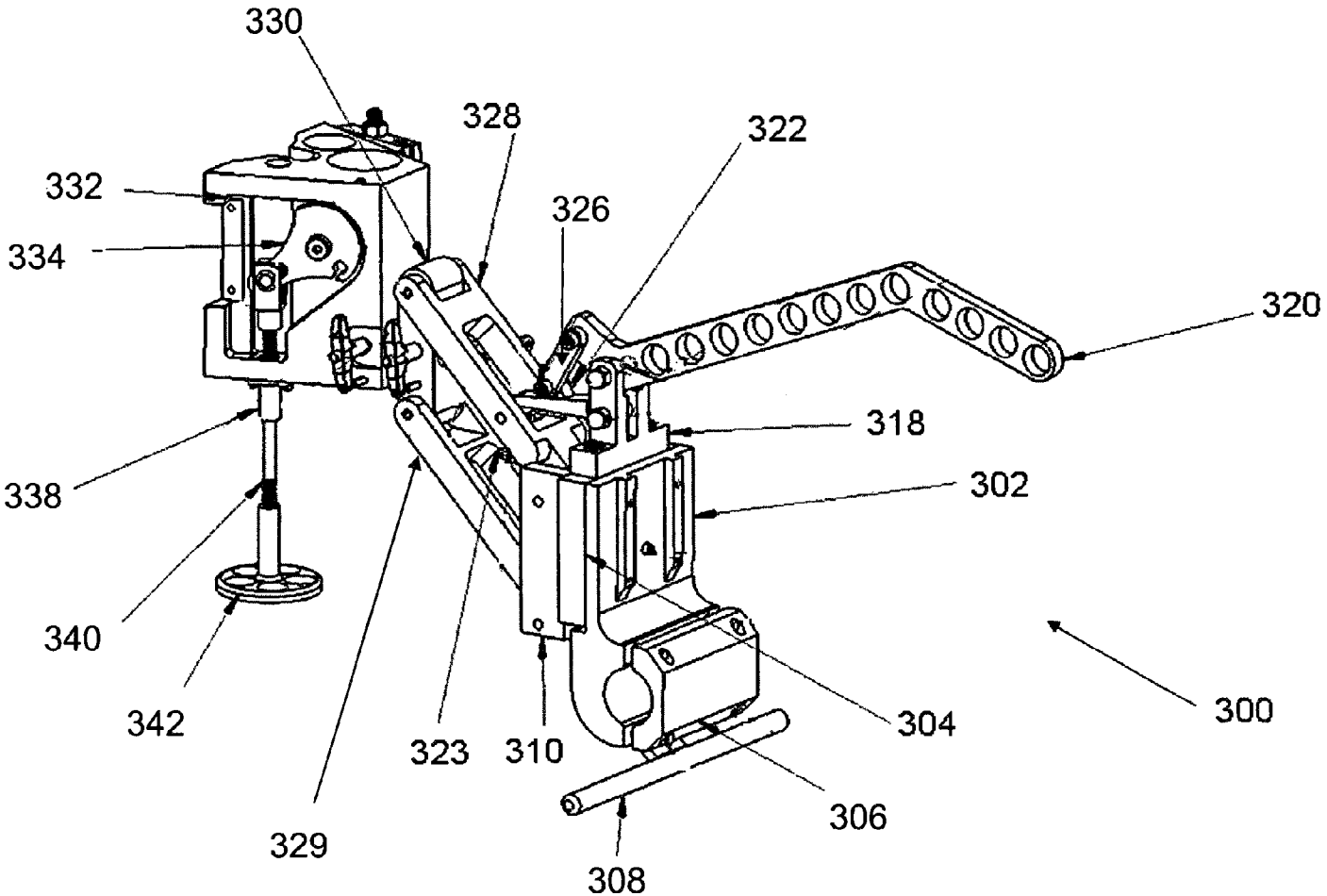
FIGS. 4(*a*) to 4(*d*) illustrate an embodiment of the present invention including a container placement assembly for use with a first prior art robot.
Figure 4B:
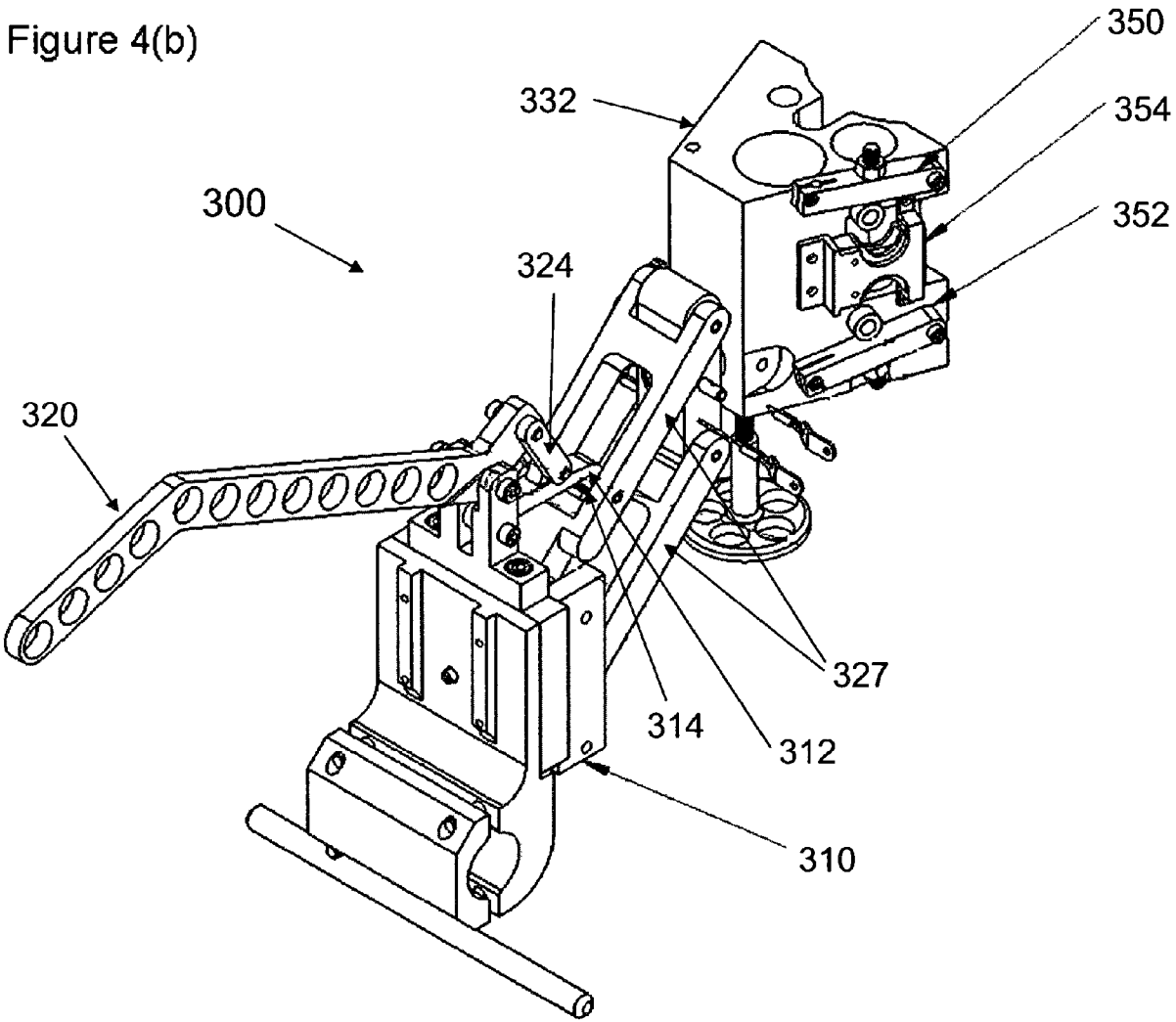
Figure 4C:
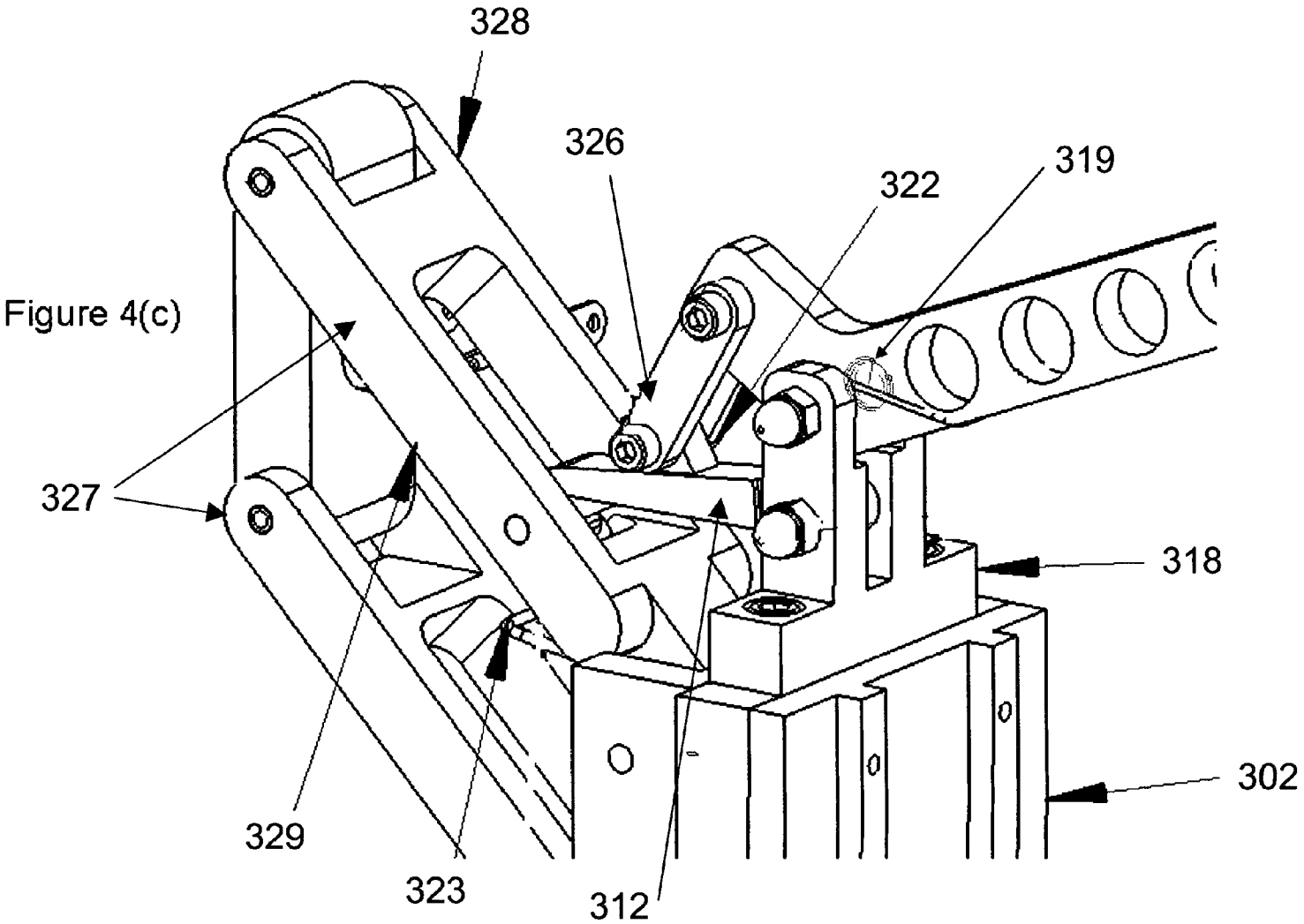
Figure 4D:
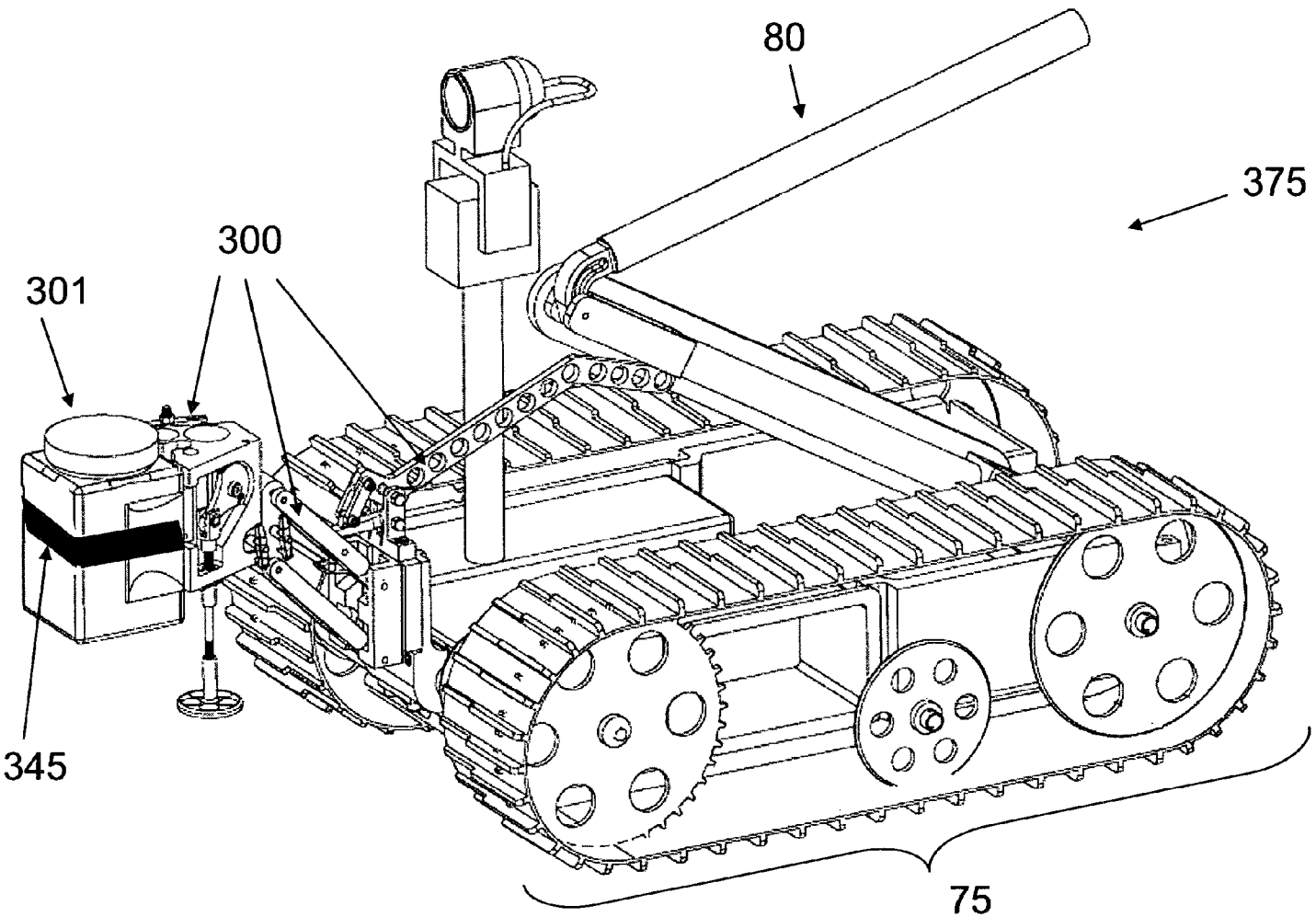

FIGS. 3(*a*) to 3(*c*) illustrate a third embodiment of the present invention that includes a pan disruptor configuration for use with the iRobot PackBot robots such as the EOD and MTRS versions. More particularly, FIG. 3(*a*) is an exploded view of pan disruptor assembly 200. Similar to the disruptor configurations described above, the pan disruptor assembly 200 includes disruptor gun 202 which is held in position by a series of components including pan clamp 204, pivot supports 206, and cross bars 208. The pivot supports 206 are each connected to flanges 210 which are connected to front support block 218. Attached to the outward facing side of each flange 210 are horizontal shock supports 212 which are in turn connected to vertical shock supports 214 and shock absorbers 216. The front support block 218 is attached to support slides 220 and shock absorber 222. Shock absorber 222 is attached to horizontal recoil support 224, which is in turn connected to pan mount outer tool clip 228. A cross bar shock support 226 is attached to pan mount outer tool clip 228 as is sled tool clip 234 and top tool pad disruptor 236. A T-slide 230 with toolbar ballast 232 for affixing the pan disruptor 200 to the PackBot robot is attached to the bottom of the front support block 218.

FIG. 3(*b*) illustrates an unexploded view of the pan disruptor configuration for use with the iRobot PackBot robot.

FIG. 3(*c*) illustrates the combined system 250 including pan disruptor assembly 200 attached to an iRobot PackBot robot 240. FIG. 3(*c*) also illustrates toolbar rod 402 which attaches to the pan disruptor assembly 200 at toolbar ballast 232. Toolbar rod 402 is attached to the robot 240 via flanges 442 which are components of a flipper assembly 440. In combination with the shock absorbers, the toolbar rod 402 transfers the load of the disruptor shot to the chassis of the robot.

A fourth embodiment of the present invention is directed to a system for remotely placing a container, e.g., containing water and/or explosives. Water is an effective tool for disrupting the circuitry and fuses for IEDs. Accordingly, the ability to place a container of water near an IED so that it can be exploded in order to disrupt circuitry, fuses and the like is needed. In particular, a system that allows for the remote placement of the water container in order to shield human operators is preferred. Referring to FIGS. 4(*a*) through 4(*d*), a container placement system 300 for use with the Talon robot is shown. The water container placement system 300 is attached to the Talon robot via the top tool pad 302 and bottom tool clamp 306 which clamp on to a bar located on the lower front end of the Talon robot (not shown in this view). The top tool pad 302 is connected to outer tool clip 304 which is in turn connected to pinion support block 310. There is an anti-rotation bar 308 for stabilizing the entire tool attachment. Next, the system 300 includes a clevis pin mount 318 connected to spring pin actuating arm 320 which mechanically actuates top pinion arm 328 and bottom pinion arm 329 which form a parallelogram assembly 327 (see FIGS. 4(*b*) and 4(*c*)) via a dual torsion spring comprised of top arm spring 322 and lower pinion spring 323. The spring pin actuating arm 320 is actuated via top arm recoil spring 319. When the parallelogram assembly 327 is actuated via the spring pin actuating arm 320, this causes hook arm links 326 (and 324 shown in FIG. 4(*b*)) to effect unhooking of hook 312 from its retaining pin 314 (see FIGS. 4(*b*) and (*c*)). The actuating arm 320 is caused to actuate when the Talon robot arm 80 depresses on the actuating arm 320 during the stowing operation of the arm 80.

When hook 312 comes off of retaining pin 314, the parallelogram assembly 327 moves so as to lower holding block 332 which is attached to the parallelogram assembly 327 via front rack support 330. When holding block 332 is dropped, foot actuator 342 hits the ground and threaded coupler 338 attached to the foot actuator 342 through threaded rod 340 is pushed up which causes a cam 334 to pull a cable (not shown) actuating top and bottom buckle actuators 350 and 352 to cause buckle 354 to release the strap 345 that is holding the water container from holding block 332. The strap may be a Velcro strap. The holding block 332 may be a suitable material such as Delrin. The containers vary in size and weight, e.g., approximately 4 to 12 pounds. In a particular example, the container is a plastic bottle filled with water and a shaped charge of C-4 explosive is placed facing the target. The orientation of the bottle is critical in order to be effective. Differing sizes of plastic bottles can be used depending upon the size of the target. The threaded rod 340 allows for adjustment in height to accommodate varying sizes of plastic bottles. Once the water container is in place, a blasting cap sets off the explosive via a detonation cord from the bottle to a user.

FIG. 4(*b*) illustrates an opposite side view of water container placement system 300. While FIG. 4(*c*) illustrates a close-up view of the hook release components. Finally, FIG. 4(*d*) shows a completed system 375 including container placement system 300 attached to Talon robot 75.

Figure 5A:
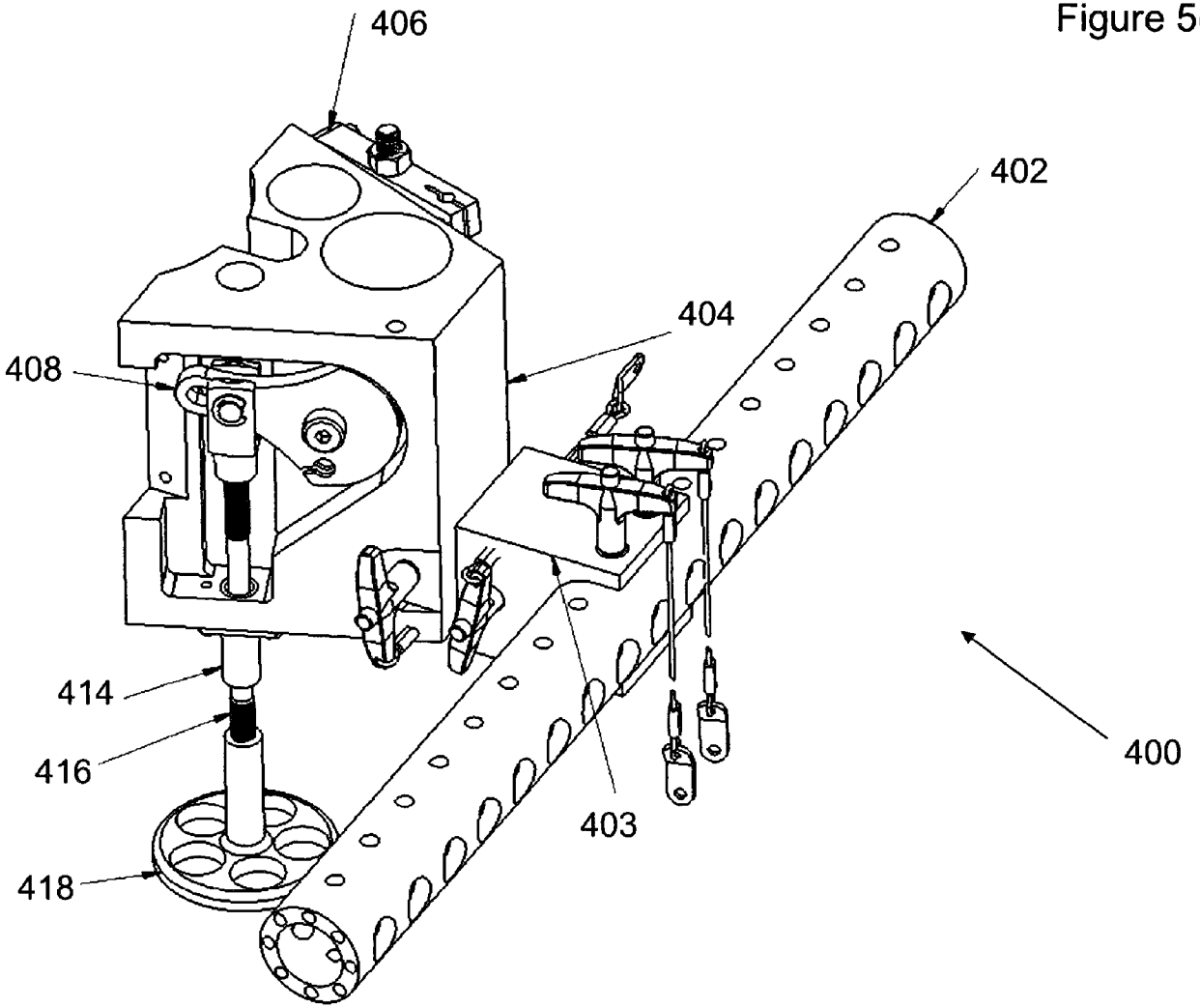
FIGS. 5(*a*) to 5(*c*) illustrate an embodiment of the present invention including a container placement assembly for use with a second prior art robot.
Figure 5B:
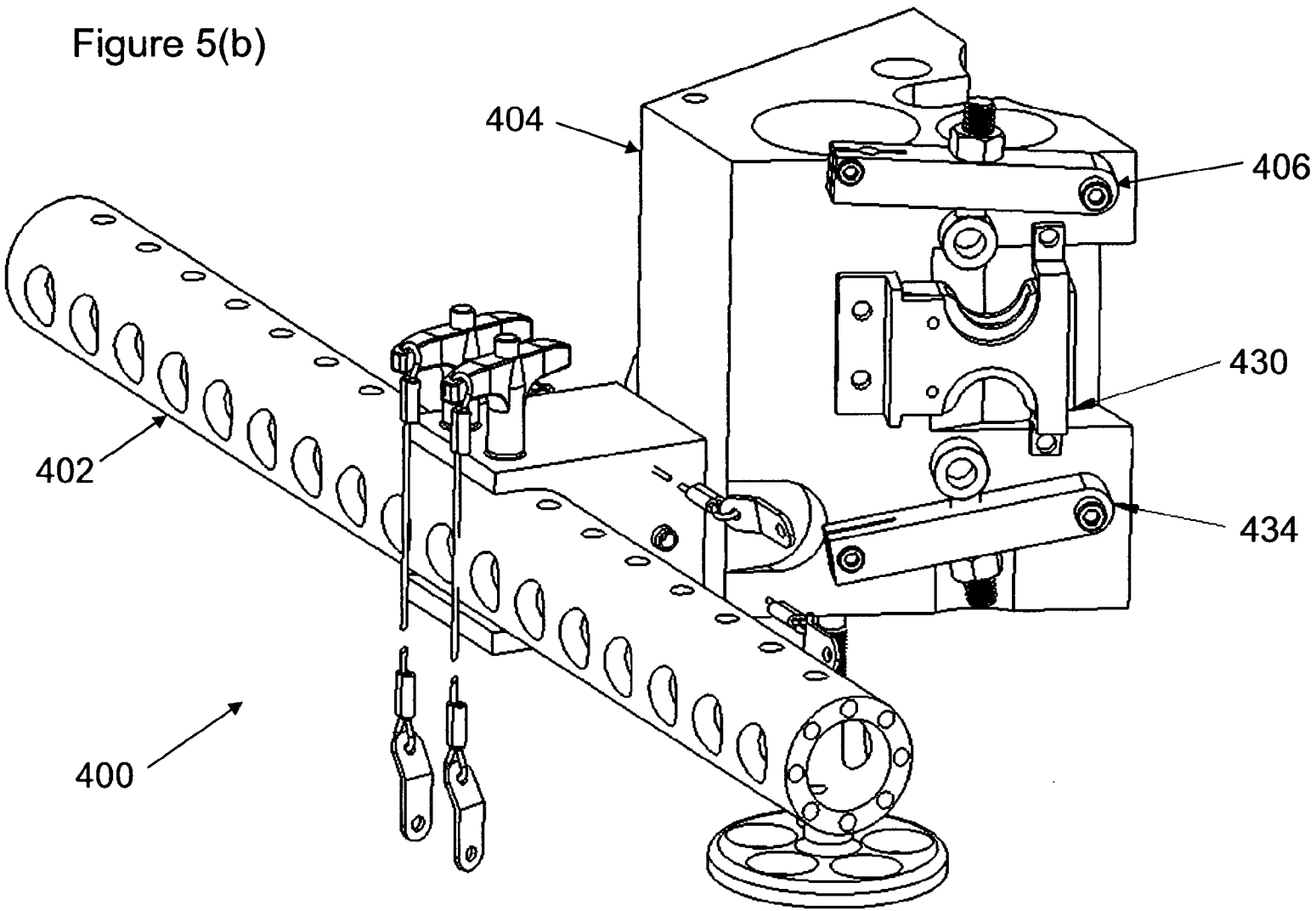
Figure 5C:
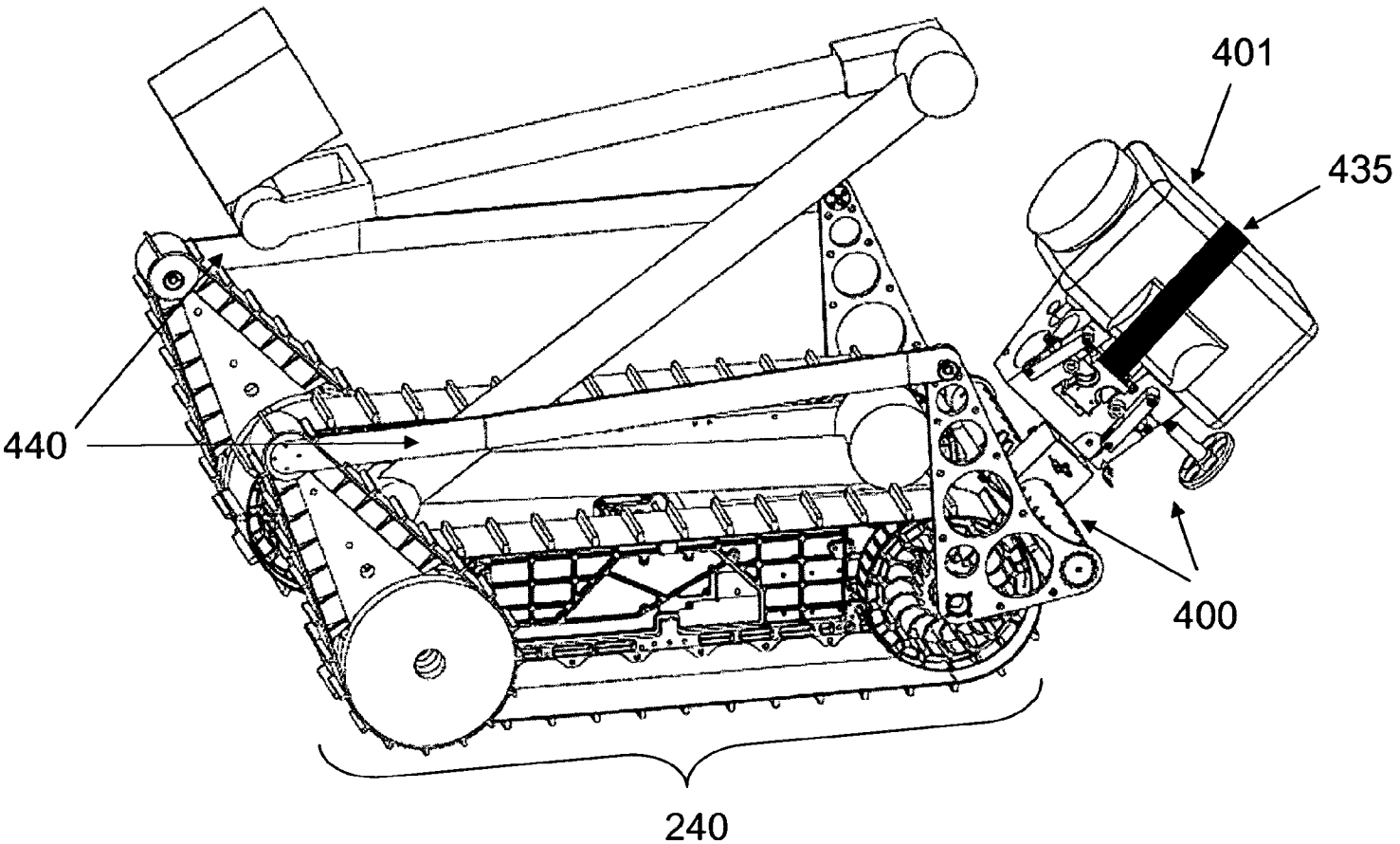
Figure 6A:
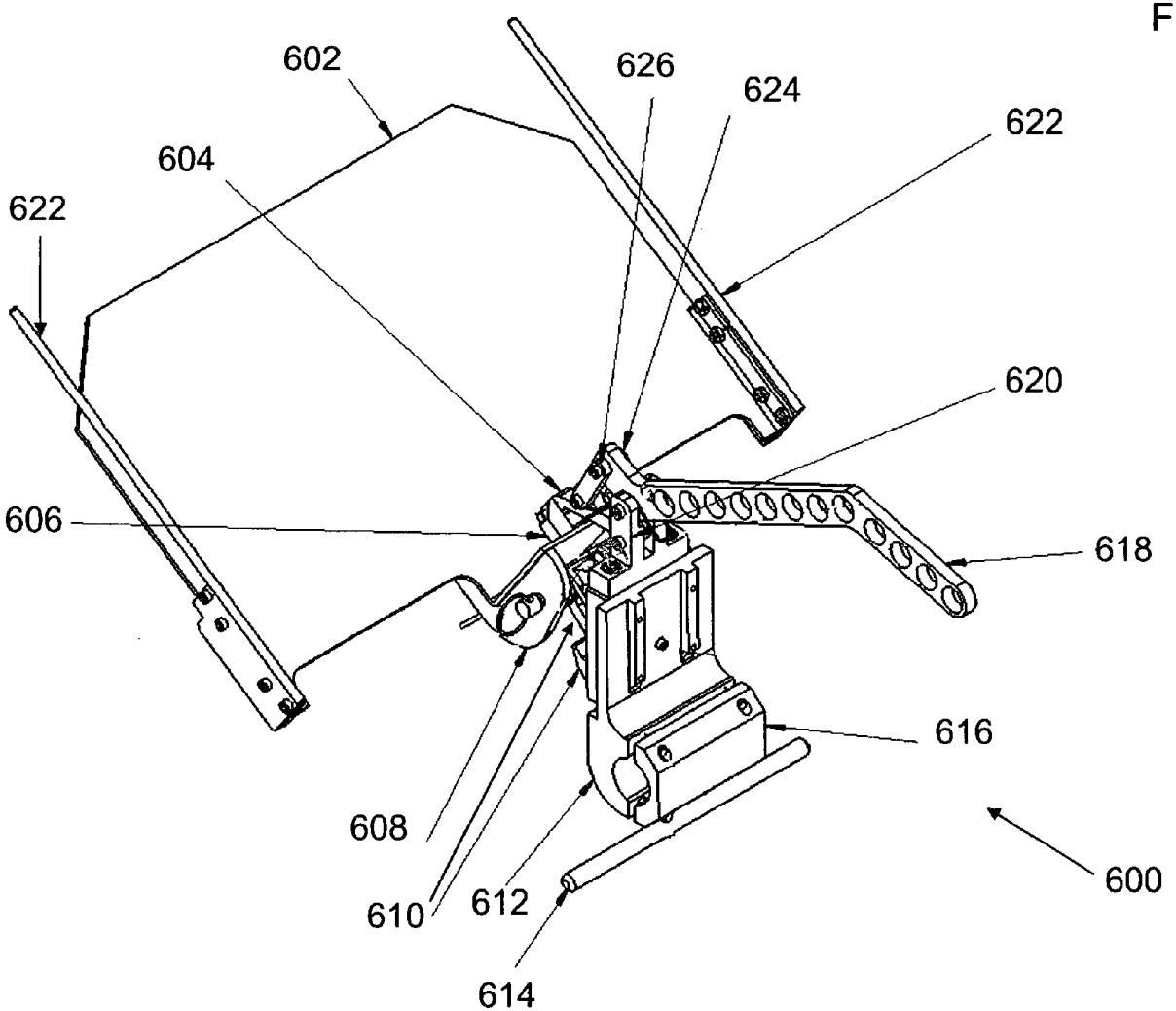
FIGS. 6(*a*) to 6(*e*) illustrate an embodiment of the present invention including a second container placement assembly for use with a first prior art robot.
Figure 6B:
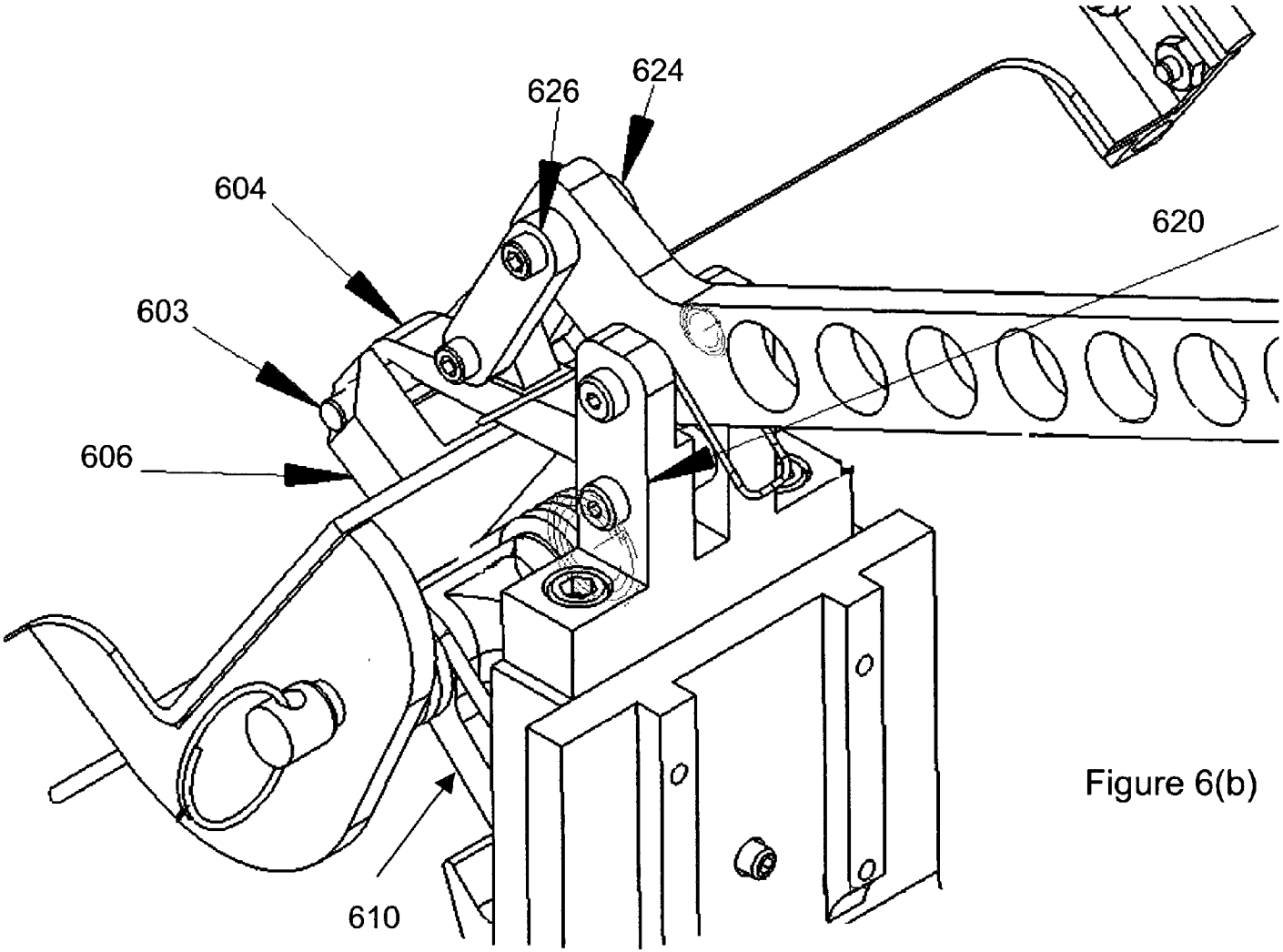
Figure 6C:
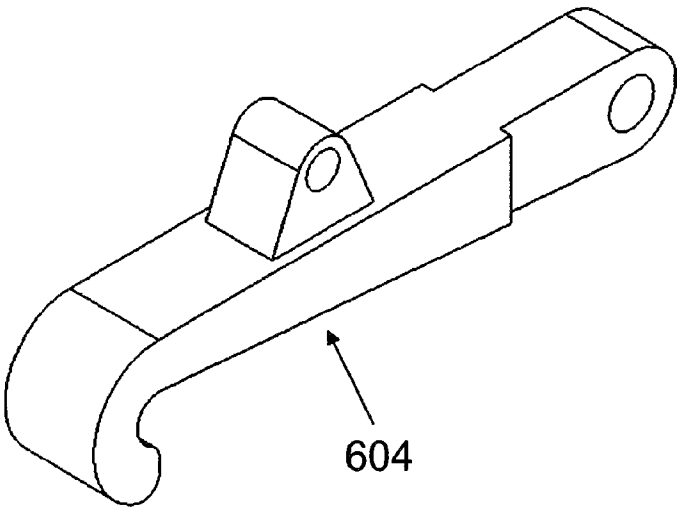
Figure 6D:
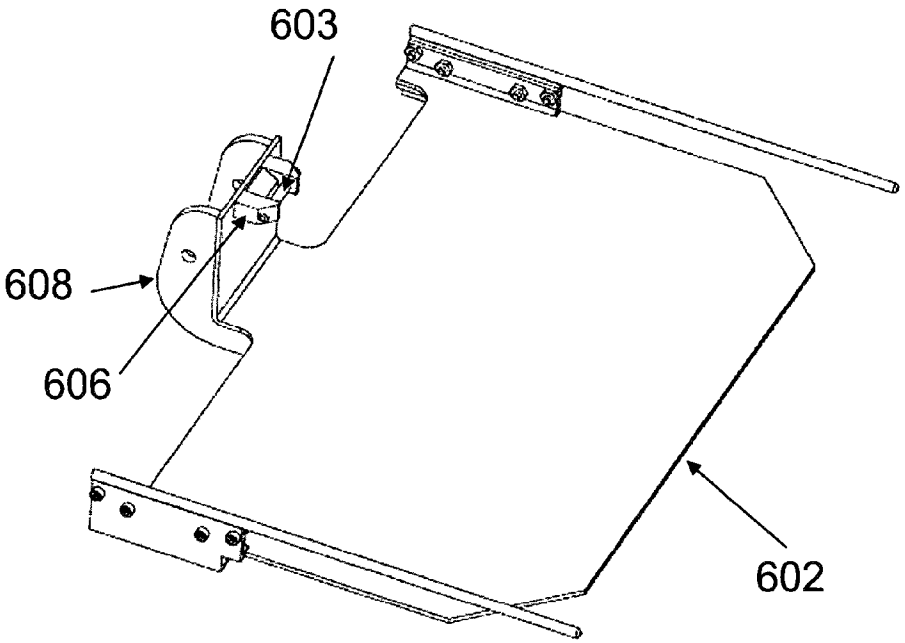
Figure 6E:
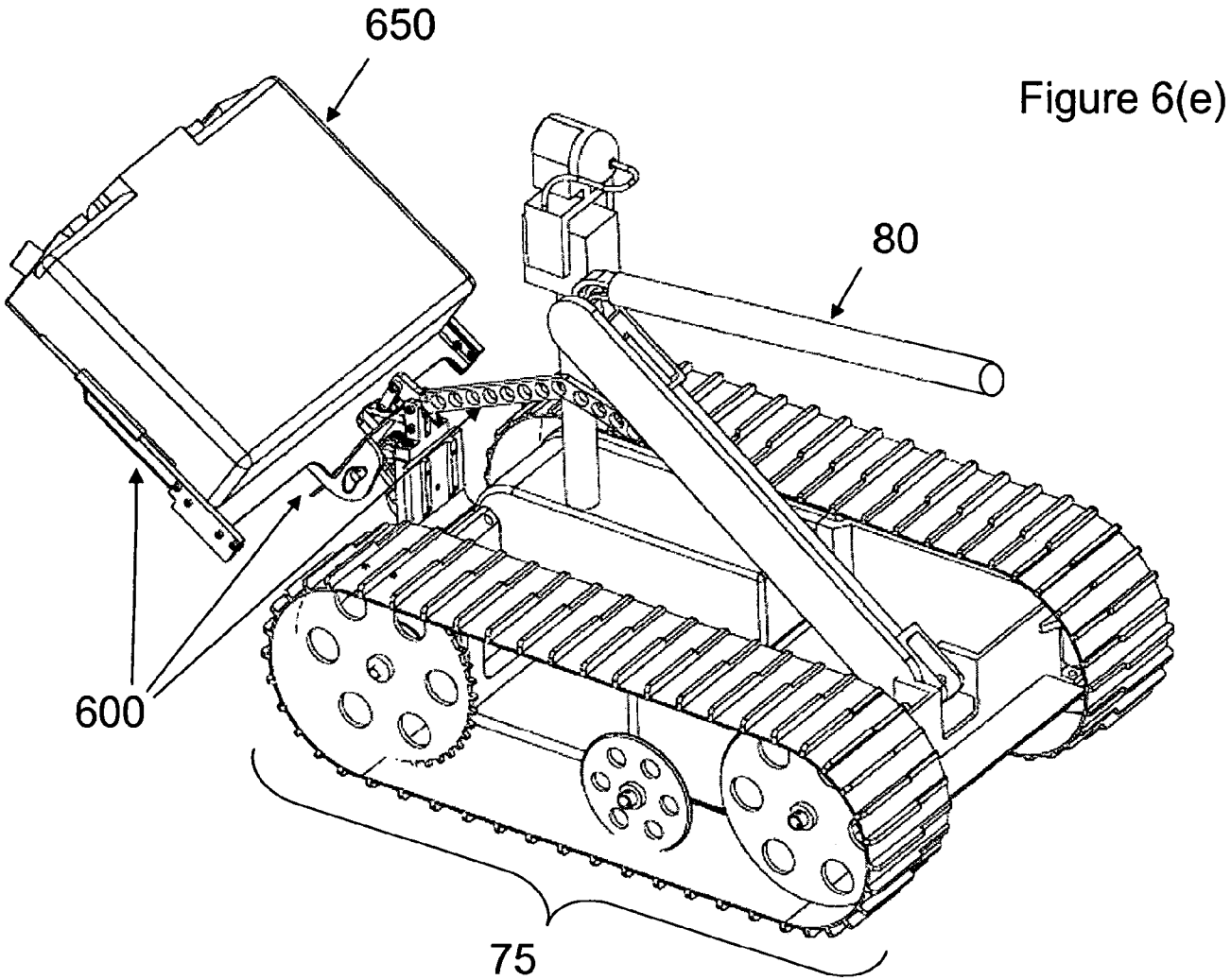

In a fifth embodiment of the present invention shown in FIGS. 5(*a*) through 5(*c*), a container placement system (e.g., containing water and/or explosives) 400 is configured for attachment to the PackBot robot (see FIG. 5(*c*)) at toolbar rod 402 via front mount 403. Front mount 403 is attached to holding block 404 which holds and releases a container 401. In operation, tool bar rod 402 is moved by a lowering mechanism which includes flipper assembly 440 present on the PackBot robot 240. When tool bar rod 402 is moved so as to lower the holding block 404, foot actuator 418 touches the ground and pushes threaded coupler 414 attached to the foot actuator 418 through threaded rod 416 moving the cam 408 to pull a cable (not shown) actuating top and bottom buckle actuators 406 and 434 to cause buckle 430 to release the strap 435 that is holding the water container 401 from holding block 404.

As discussed above, the strap may be a Velcro strap. The holding block 404 may be a suitable material such as Delrin. Once the water container is in place, a separate actuation mechanism is employed to explode the water container such as via a blasting cap and detonation cord to the container controlled by the user. These trigger actuator mechanisms are known to those skilled in the art. Also as described above, the containers vary in size and weight, e.g., approximately 4 to 12 pounds. In a particular example, the container is a plastic bottle filled with water and a shaped charge of C-4 explosive is placed facing the target. The orientation of the bottle is critical in order to be effective. Differing sizes of plastic bottles can be used depending upon the size of the target. The threaded rod 416 allows for adjustment in height to accommodate varying sizes of plastic bottles.

FIG. 5(*b*) illustrates an opposite side view of water container placement system 400. While FIG. 5(*c*) shows a completed system 450 including container placement system 400 attached to PackBot robot 240.

Referring to FIGS. 6(*a*) through 6(*e*), a sixth embodiment of the present invention is directed to a placement system 600 for placing an explosive device for disrupting an IED or the like. The system is similar to the system described with reference to FIGS. 4(*a*) and 4(*b*) in components and operation. Top tool pad and bottom tool clamp 612 and 616 attach the placement mechanism to the Talon robot. There is an anti-rotation bar 614 for stabilizing the entire tool attachment. The top tool pad 612 is attached to pivot component 610 which includes clevis pin mount 620 attached to actuation arm 618 and springs (not shown). Also attached to pivot component 610 is tray support arm 608 and support bar 606. The actuation arm 618 is further attached to hook linkage arms 624 and 626 which are in turn connected to hook 604. The tray 602 and tray supports 622 hold an explosive device, e.g., a briefcase filled with explosives. In operation, when actuation arm 618 is actuated, hook 604 is lifted from retaining pin 603 causing tray 602 to drop which allows the explosive device to slide off of the tray 602. Springs (not shown) are also used to lift the tray back up off the ground. The actuation arm 618 is caused to actuate when the Talon robot arm 80 depresses on the actuating arm 618 during the stowing operation of the arm 80.

FIGS. 6(*c*) shows an example of hook 604 (also representative of hook 312). FIG. 6(*d*) illustrates tray 602, retaining pin 603, support bar 606 and tray support arm 608. Finally, FIG. 6(*e*) shows a completed system 675 including Talon robot 75, placement system 600 and representative explosive device 650.

Figure 7:
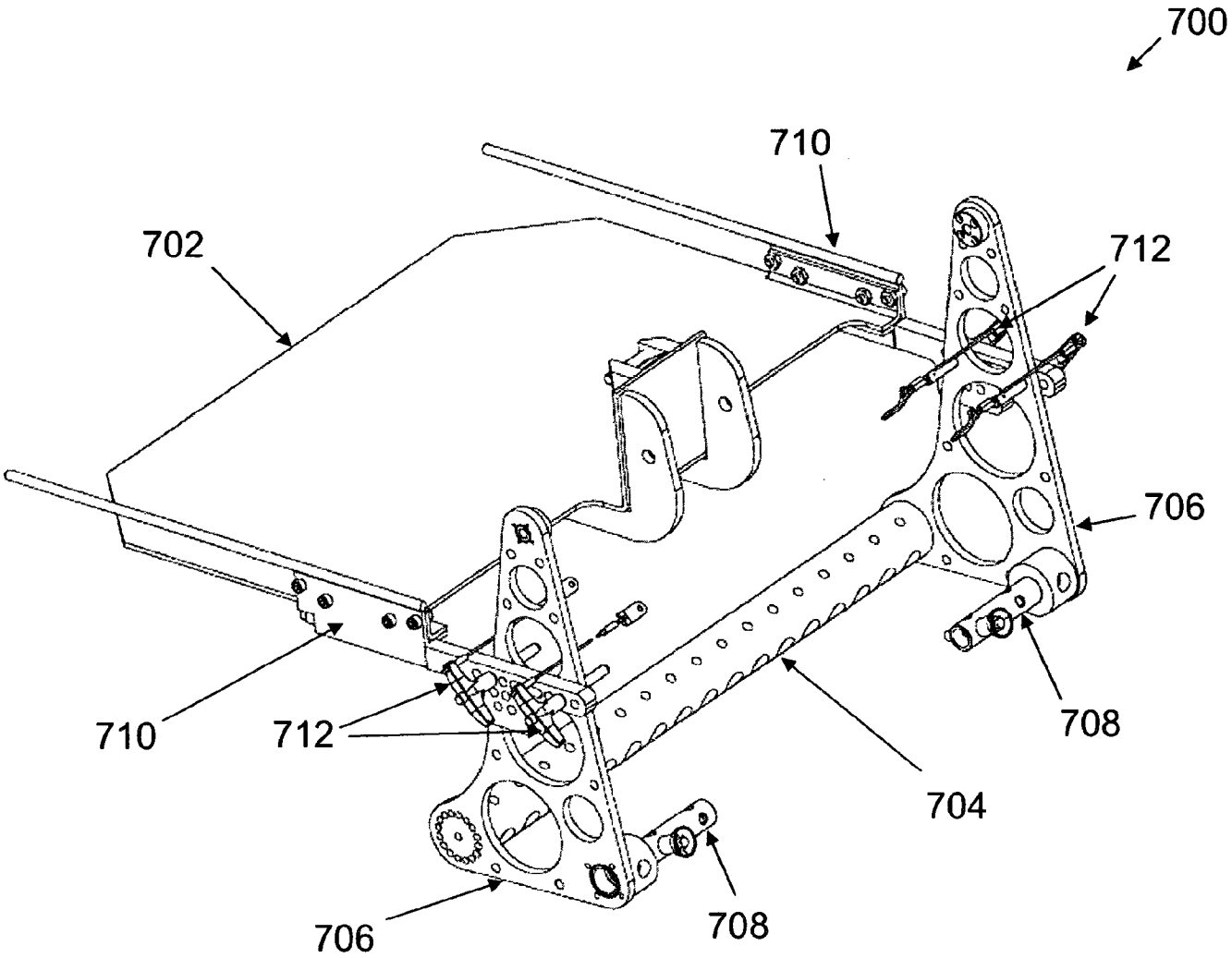
FIG. 7 illustrates an embodiment of the present invention including a second container placement assembly for use with a second prior art robot.

Referring to FIG. 7, a seventh embodiment of the present invention is directed to a placement system 700 for placing an explosive device for disrupting an IED or the like. The system includes support tray 702 (see FIG. 6(*d*)) which is attached to the PackBot robot (not shown) via a lift assembly (shown as 440 in FIG. 5(*c*)) comprised of toolbar rod 704, flanges 706, axle attachment pins 708. More particularly, support tray 702 includes tray support arms 710 which are attached to flanges 706 via tray attachment pins 712. In operation, when the toolbar rod 704 is caused to move down, the support tray 702 drops down which allows an explosive device to slide off of the tray and be placed next to, e.g., an IED.

The embodiments sets forth herein are intended to be exemplary. One skilled in the art recognizes the variations to the mechanical configurations, materials, and the like which are still considered to be within the scope of the invention. Further, though the embodiments are described and illustrated for use with particular robots, one skilled in the art recognizes that the tools may be used in conjunction with any robot having appropriate actuating components, e.g., arms, lowering mechanisms, etc.

We claim:

1. A system for placing a disruptive device near a target, the system comprising:

a remote controlled vehicle including a remotely controllable arm;

a first subsystem including:

a movable arm, a hook, a retaining pin, and a lowering mechanism, a second subsystem including a holder for holding the disruptive device and a release mechanism for releasing the disruptive device near the target;

wherein the release mechanism releases the disruptive device from the holder when the remotely controllable arm causes the movable arm to unhook the hook from the retaining pin which causes the lowering mechanism to drop the second subsystem which triggers the release mechanism.

2. The system according to claim 1, wherein the first subsystem further includes securing means for securing the first and second subsystems to the vehicle.

3. The system according to claim 1, wherein the lowering mechanism includes parallel arms attached at a first end to the securing means and at a second end to the holder.

4. The system according to claim 1, wherein the release mechanism further includes:

a cam, at least one buckle, at least one strap, and a foot actuator, wherein when the second subsystem drops, the foot actuator hits the ground causing the cam to release the buckle which holds the strap, thus releasing the disruptive device from the holder.

5. The system according to claim 1, wherein the lowering mechanism includes at least one spring.

6. The system according to claim 1, wherein the disruptive device is a plastic container.

7. The system according to claim 4, wherein the release mechanism further includes an adjustable leg connecting the foot actuator to the holder, the leg being adjustable to accommodate multiple sizes of disruptive devices.

* * * * *